US011821137B2

(12) United States Patent
Shin et al.

(10) Patent No.: US 11,821,137 B2
(45) Date of Patent: Nov. 21, 2023

(54) WRINKLE REMOVAL MODULE

(71) Applicant: LG ELECTRONICS INC., Seoul (KR)

(72) Inventors: Woosup Shin, Seoul (KR); Sungho Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 463 days.

(21) Appl. No.: 16/526,660

(22) Filed: Jul. 30, 2019

(65) Prior Publication Data

US 2021/0032797 A1 Feb. 4, 2021

(51) Int. Cl.

| | |
|---|---|
| ***D06F 73/02*** | (2006.01) |
| ***D06F 67/00*** | (2006.01) |
| ***D06F 58/10*** | (2006.01) |
| *D06F 58/20* | (2006.01) |

(52) U.S. Cl.
CPC ..... *D06F 73/02* (2013.01); *D06F 58/10* (2013.01); *D06F 67/005* (2013.01); *D06F 58/203* (2013.01)

(58) Field of Classification Search
CPC ..... D06F 58/10; D06F 67/005; D06F 73/02; D06F 58/203
See application file for complete search history.

(56) References Cited

U.S. PATENT DOCUMENTS

| | | | | |
|---|---|---|---|---|
| 8,893,935 | B2 | 11/2014 | Paez et al. | |
| 9,309,618 | B2 | 4/2016 | Park et al. | |
| 9,809,924 | B2 | 11/2017 | Park et al. | |
| 2005/0115120 | A1* | 6/2005 | Cevik | D06F 73/02 38/14 |

(Continued)

FOREIGN PATENT DOCUMENTS

| | | | |
|---|---|---|---|
| CN | 200964529 | Y | 10/2007 |
| CN | 104120599 | A | 10/2014 |

(Continued)

OTHER PUBLICATIONS

PCT International Search Report (Application No. PCT/KR2020/008754) dated Oct. 14, 2020.

(Continued)

*Primary Examiner* — Benjamin L Osterhout
(74) *Attorney, Agent, or Firm* — Birch, Stewart, Kolasch & Birch, LLP

(57) ABSTRACT

A clothes treatment apparatus includes a cabinet that defines a treatment chamber, equipment configured to release at least one of hot air, steam, or cooled air into the treatment chamber, and a door that opens and closes the treatment chamber. A wrinkle removal module is pivotally mounted on a backside of the door. The wrinkle removal module applies a tension force to a first article of clothing in a first configuration and a compression force to a second article of clothing in a second configuration. The wrinkle removal module includes a base plate supported in a fixed position on the door, and a bi-fold panel assembly pivotally supported on the door. Panels of the bi-fold panel assembly include clips for clamping on portions of the first article of clothing to apply the tension force to the first article of clothing when the panels are pivoted relative to each other.

14 Claims, 22 Drawing Sheets

(56) References Cited

U.S. PATENT DOCUMENTS

| | | | | |
|---|---|---|---|---|
| 2005/0223502 | A1* | 10/2005 | Kleker | D06F 58/10 68/5 R |
| 2009/0064531 | A1* | 3/2009 | Moon | D06F 58/10 34/218 |
| 2016/0177498 | A1 | 6/2016 | Park et al. | |
| 2018/0135236 | A1* | 5/2018 | Lim | D06F 67/00 |
| 2018/0135237 | A1* | 5/2018 | Yoon | D06F 71/34 |

FOREIGN PATENT DOCUMENTS

| | | | |
|---|---|---|---|
| CN | 104294529 | A | 1/2015 |
| CN | 205242139 | U | 5/2016 |
| EP | 2826911 | | 1/2015 |
| JP | H08024499 | | 1/1996 |
| KR | 10-1056610 | | 8/2011 |
| KR | 10-2012-0091799 | | 8/2012 |
| KR | 10-20150047766 | | 5/2015 |
| WO | WO2019/194567 | | 10/2019 |

OTHER PUBLICATIONS

European search report (Application No. 20188350.1-1016) dated Dec. 18, 2020.

* cited by examiner

WRINKLE REMOVAL MODULE

TECHNICAL FIELD

The present disclosure relates to a clothes treatment apparatus, and, more particularly, a clothes treatment apparatus that removes wrinkles from articles of clothing by applying compression or tension to the articles of clothing while exposing the clothing to steam.

BACKGROUND

Clothes treatment apparatus are designed to wash and dry clothes and to eliminate wrinkles in clothes, at home or at laundromats. Some classifications of clothes treatment apparatus may include washers for washing clothes, dryers for drying clothes, washer/dryer combinations having both washing functions and drying functions, refreshers for refreshing clothes, and steamers for removing wrinkles in clothes.

A refresher is an apparatus that helps in keeping clothes comfortable and fresh. The refresher functions to dry clothes, supply fragrance to clothes, prevent the occurrence of static electricity in clothes, and remove some wrinkles from clothes.

A steamer is an apparatus that supplies steam to clothes in order to remove wrinkles from the clothes. Unlike a general iron, the steamer removes wrinkles from the clothes without directly applying heat to the clothes through conduction (i.e., a solid object directly touching the clothes).

SUMMARY

In one aspect, the present disclosure is directed to a clothes treatment apparatus including a cabinet that defines a treatment chamber, steam producing equipment contained within the cabinet and configured to release steam into the treatment chamber, and a door configured to open and close the treatment chamber. A wrinkle removal module is located on a backside of the door and is configured to apply a tension force to a first article of clothing in a first configuration of the wrinkle removal module and apply a compression force to a second article of clothing in a second configuration of the wrinkle removal module.

In another aspect, the present disclosure is directed to a clothes styling apparatus that includes a cabinet defining a treatment chamber, a door that opens and closes the treatment chamber, and a wrinkle removal module located on a backside of the door and configured to apply a tension force to a first article of clothing in a first configuration of the wrinkle removal module and apply a compression force to a second article of clothing in a second configuration of the wrinkle removal module. The clothes styling apparatus includes a base plate supported in a fixed position on the door, and a bi-fold panel assembly including a first panel pivotally supported on the door, and a second panel pivotally supported on the first panel. Each of the first and second panels includes at least one clip for clamping on a portion of the first article of clothing to apply the tension force to the first article of clothing when the first and second panels are pivoted relative to each other.

In yet another aspect, the present disclosure is directed to a method of removing wrinkles from articles of clothing using clothes styling apparatus including a cabinet that defines a treatment chamber, steam producing equipment contained within the cabinet and configured to release steam into the treatment chamber, a door configured to open and close the treatment chamber, a base plate supported in a stationary position on a backside of the door, and a wrinkle removal module pivotally mounted on the backside of the door. The method includes applying a tension force to a first article of clothing in a first configuration of the wrinkle removal module, and applying a compression force to a second article of clothing in a second configuration of the wrinkle removal module.

DETAILED DESCRIPTION

Figure 1:
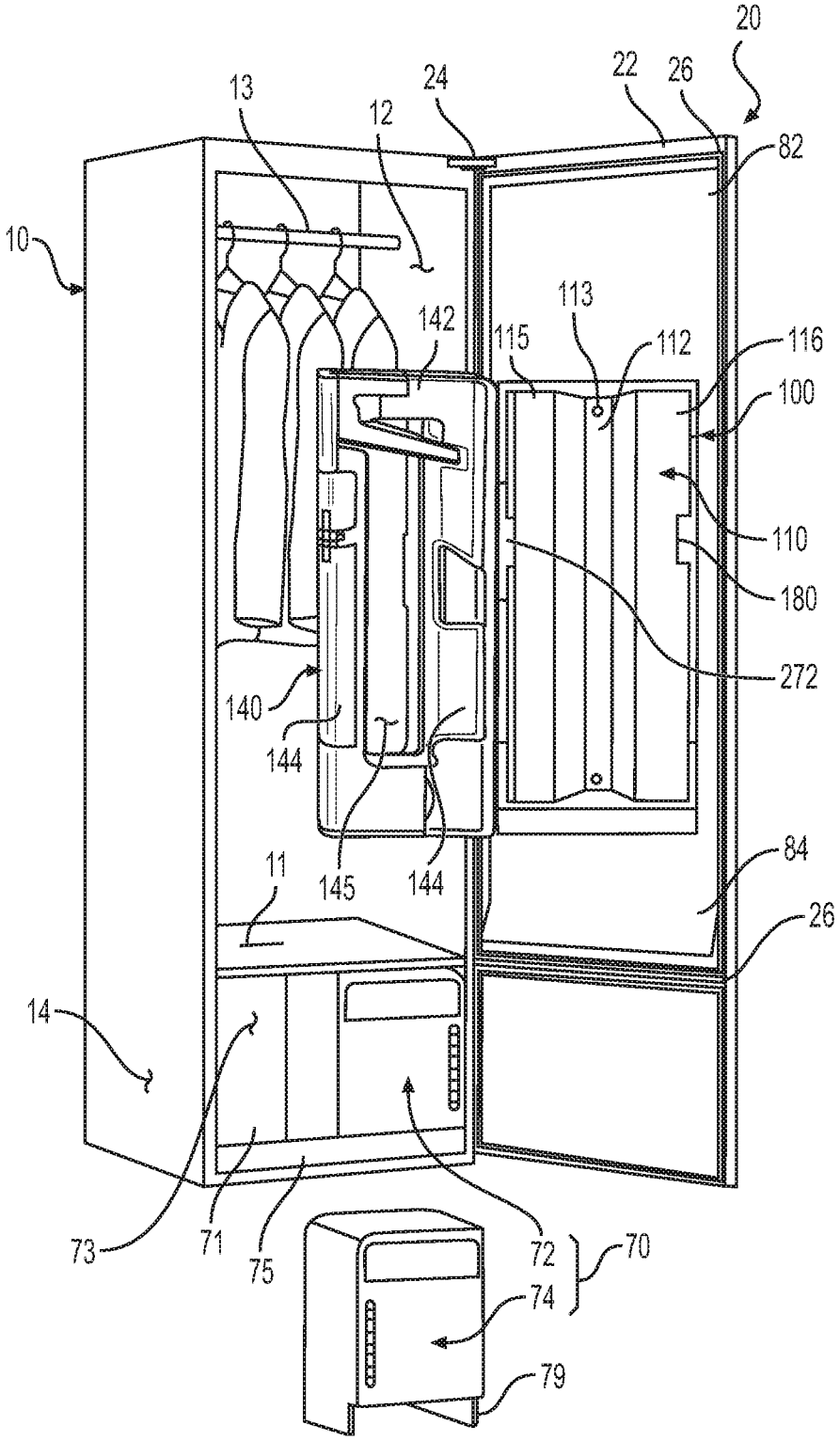
FIG. 1 is a perspective view of an exemplary clothes treatment apparatus.

FIG. 1 illustrates an exemplary clothes treatment apparatus according to various embodiments of this disclosure. Hot air and steam generation equipment may be included in a lower interior portion 14 of the exemplary clothes treatment apparatus of FIG. 1.

The clothes treatment apparatus 1 shown in FIG. 1 may include a cabinet 10, and cabinet 10 may define a treatment chamber 12 that is open at a front of cabinet 10, with a door 20 configured to open and close the front of cabinet 10.

The interior of cabinet 10 may be partitioned into upper and lower interior portions by a partition plate 11, with treatment chamber 12 being defined within the upper interior portion of cabinet 10. Clothes such as shirts and trousers may be hung in treatment chamber 12 of cabinet 10, and steam and/or hot air may be introduced into treatment chamber 12 from the hot air and steam generation equipment located below partition plate 11 in lower interior portion 14 of cabinet 10.

Clothes may be hung in treatment chamber 12 and subjected to tensioning and/or compression while also being exposed to the hot air and/or steam introduced into treatment chamber 12. As a result, clothes treated in treatment chamber 12 may be deodorized, refreshed, and sanitized, and wrinkles in the clothes may be removed. In various exemplary embodiments, a hanger support bar 13 may be disposed in the upper part of treatment chamber 12 and configured to support clothes to be treated hanging on clothes hangers. Hanger support bar 13 may be configured for controlled movement in treatment chamber 12 by a driving device, such as a motor. Movement of hanger support bar 13 with clothes hung on hangers supported on hanger support bar 13 may include vibratory movements, up and down movements, and sideways movements that may shake the clothes while the clothes are exposed to hot air and/or steam in treatment chamber 12, thus assisting with removal of wrinkles from the clothes.

Air blowing ports and steam discharge ports may be formed in partition plate 11 in order to provide passageways for hot air and steam produced in lower interior portion 14 to pass up into treatment chamber 12. In some implementations, the air blowing ports and steam discharge ports may be formed in different panels, such as a separate discharge panel at the rear side of partition plate 11 and forming a continuous surface with partition plate 11.

Equipment housed in lower interior portion 14 may include a blowing unit for circulating air in treatment chamber 12, a steam unit for supplying steam into treatment chamber 12, a heat pump unit for conditioning air in treatment chamber 12, and a control unit for controlling the respective hot air and steam generation units and air circulation units installed in lower interior portion 14. A fan located in lower interior portion 14 may draw air from treatment chamber 12 into the heat pump unit also located in lower interior portion 14. A steam generation unit generates heat and converts water supplied from a water supply tank into steam that may then be introduced into treatment chamber 12. The heat pump unit located in lower interior portion 14 may include a compressor, a condenser, an evaporator, and an expansion valve, and may be configured to produce cooled air or heated air that is then discharged into treatment chamber 12.

In some implementations, the heat pump unit may heat air around the condenser through heat exchange with a refrigerant and may supply the heated air into treatment chamber 12 through a blowing unit. In a reversal of the heat pump cycle, the heat pump may instead provide cooled and conditioned air into treatment chamber 12. The hot air, or in some implementations, cooled air supplied into treatment chamber 12 may be used to treat clothes or other fabric items that are hung on hangers supported by hanger support bar 13.

A tank module 70 for storing water may be installed in a front portion of lower interior portion 14, and tank module 70 may include a water supply tank 72 for supplying water to a steam unit and a drainage tank 74 for collecting and storing condensed water that is generated in treatment chamber 12. In some implementations, a tank module frame 71 may be installed in front of an inlet duct passing through partition plate 11. A tank installation space 73 may be defined between tank module frame 71 and door 20. Tank module frame 71 may be coupled to partition plate 11 to isolate lower interior portion 14 from the outside. A tank support bar 75 installed in front of tank installation space 73 may interfere with a tank support member 79 and prevent water supply tank 72 or drainage tank 74 from being unintentionally separated from tank installation space 73. When door 20 is opened and closed, water supply tank 72 and drainage tank 74 are prevented from being separated from tank installation space 73 by tank support bar 75. When desired, water supply tank 72 and drainage tank 74 may be withdrawn by a user.

Door 20 may include a door panel 22 on a backside of door 20 facing treatment chamber 12 when door 20 is in a closed position, at least one hinge unit 24 for connecting door 20 and door panel 22 to cabinet 10 in a hinged fashion, a door gasket 26 disposed at door panel 22 such that door gasket 26 is in tight contact with the edge of cabinet 10 to achieve a seal between door 20 and cabinet 10, and a door liner 82, 84 disposed at door panel 22 for guiding condensed water that is generated in treatment chamber 12 to partition plate 11 when door 20 is closed. In some implementations, door 20 is configured to have a structure that simultaneously opens and closes treatment chamber 12 and tank installation space 73. In other implementations, a plurality of doors may be mounted to cabinet 10 such that the respective doors can separately open and close treatment chamber 12 and tank installation space 73. Door liner 82, 84 is disposed facing toward treatment chamber 12 when door 20 is in a closed position, including an upper liner part 82 and a lower liner part 84. The door liner may guide condensed water that is generated on the surface thereof to a drainage grill formed through a portion of partition plate 11. Door gasket 26 may be mounted to door panel 22 such that door gasket 26 surrounds door panel 22. The seal between door 20 and cabinet 10 may be achieved by door gasket 26. Door gasket 26 may also individually seal treatment chamber 12 and tank installation space 73.

The clothes treatment apparatus according to various embodiments of this disclosure further includes a multi-functioned wrinkle removal module 100 for applying pressure to clothes or other fabric items in one configuration of wrinkle removal module 100 and/or tensioning or stretching clothes or other fabric items in another configuration of wrinkle removal module 100 while exposing the clothes or other fabric items to hot air, steam, and/or conditioned and cooled air when door 20 is closed and wrinkle removal module 100 is disposed within treatment chamber 12 to remove wrinkles from the clothes or other fabric items. As shown in the exemplary embodiment of FIG. 1, wrinkle removal module 100 may be installed on a backside of door 20 such that when door 20 is closed wrinkle removal module 100 is located inside treatment chamber 12. Wrinkle removal module 100 may include a base plate 110 installed vertically along a backside surface of door 20 or door liner 82, 84 for supporting clothes from which wrinkles are to be removed, and a bi-fold panel assembly 140 connected by one or more hinges to door 20 or directly to base plate 110 to pivot relative to base plate 110 and door 20.

A portion of base plate 110 may be spaced apart from door 20. Condensed water formed on the backside surface of door 20 as a result of steam introduced into treatment chamber 12 from lower interior portion 14 may move along door liner 82, 84 to lower liner part 84 through a gap defined between base plate 110 and door 20. At least a portion of base plate 110 may be spaced apart from door liner 82, 84 to prevent moisture on the door liner from contacting clothes. In some implementations, base plate 110 may have a plate shape or segmented plated shape with elastic characteristics. Base plate 110 may include a fixed base part 112 fixed to door 20, and an elastic base part 115, 116 extending from fixed base part 112 and being configured to be spaced further apart from door 20 than fixed base part 112. In some implementations, fixed base part 112 extends in upward and downward directions. Fixed base part 112 may be provided at upper and lower sides thereof with fastening parts 113 for coupling fixed base part 112 to door 20. Elastic base part 115, 116 may include flexible, deformable surfaces that exert an elastic force for supporting clothes or other fabric items during a pressing operation, described in greater detail below with reference to FIG. 3A. In some exemplary implementations, elastic base part 115, 116 elastically supports clothes such that the clothes are brought into uniform contact with elastic base part 115, 116 during a pressing or compression operation. Elastic base part 115, 116 may include a left elastic base part 115 extending from fixed base part 112 in a leftward direction and a right elastic base part 116 extending from fixed base part 112 in a rightward direction. When external force is applied to left elastic base part 115 and right elastic base part 116, left elastic base part 115 and right elastic base part 116 may be elastically deformed toward door 20. When the external force applied to left elastic base part 115 and right elastic base part 116 is removed, left elastic base part 115 and right elastic base part 116 may return to their original states.

Bi-fold panel assembly 140 may include a front panel pivotally connected along a proximal side edge to the backside surface of door 20 by one or more hinges, and a rear panel pivotally connected along a distal side edge of the front panel by one or more central hinges. In alternative embodiments, the rear panel may be pivotally connected along a proximal side edge to the backside surface of door 20 by one or more hinges, and the front panel may be pivotally connected along a distal side edge of the rear panel by one or more central hinges. The pivotal connections between one of the front or rear panels and the door and between the panels enables bi-fold panel assembly 140 to be reconfigured between various configurations enabling multiple wrinkle removal functions. In one exemplary configuration, the front and rear panels of bi-fold panel assembly may be pivoted to a substantially parallel and overlapping configuration with the front and rear panels pressed against each other. In another configuration, the front and rear panels may be pivoted to a substantially coplanar arrangement suitable for the mounting and clamping of an article of clothing or other fabric item that is wider than the width of one of the panels along mounting surfaces of both panels. In yet another configuration, the front and rear panels may be pivoted to form a substantially triangular configuration with base plate 110, referred to throughout this specification as a "tensioning" configuration after the mounting and clamping of an article of clothing or other fabric item on the front and rear panels with the front and rear panels in a substantially coplanar arrangement with door 20 in an opened position.

One or both of the panels may include substantially parallel compression side plates 144 and substantially parallel top and bottom interconnecting plates 142 that join compression side plates 144 and define a central opening 145 therebetween. Compression side plates 144 and interconnecting plates 142 may be formed of a material and configured for some elasticity and the ability to flex under load. In other implementations, base plate 110 may be formed of a material and configured for some elasticity, or formed from multiple elastic base parts as described above with the ability to flex under load, while the front panel and rear panel of bi-fold panel assembly 140 may be formed of a relatively rigid material with limited flexing capability. Compression side plates 144 of the rear panel of bi-fold panel assembly 140 may form the pressing surfaces that exert compression forces against an article of clothing or other fabric item mounted along base plate 110 during a pressing operation with bi-fold panel assembly 140 in a folded, overlapping configuration and pivoted against base plate 110.

As discussed below, various alternative embodiments of bi-fold panel assembly 140 may be adjustable in size by constructing at least some of the plates and members of the assembly as telescoping members and/or providing slidable extensions capable of changing the overall length and width of bi-fold panel assembly 140. A separate, flexible sheet of material may also be installed at base plate 110 in between base plate 110 and bi-fold panel assembly 140. Such a flexible sheet of material may assist with applying compression evenly over articles of clothing or other fabric items supported on base plate 110 when bi-fold panel assembly 140 is pivoted to a pressing position against base plate 110. A central hinge interlock feature may be included as part of the one or more central hinges, and may include a protrusion from a central hinge that is configured to engage with a door catch assembly on door 20 to maintain bi-fold panel assembly 140 in a compression position against base plate 110 with bi-fold panel assembly in the folded, overlapping configuration.

Figure 2A:
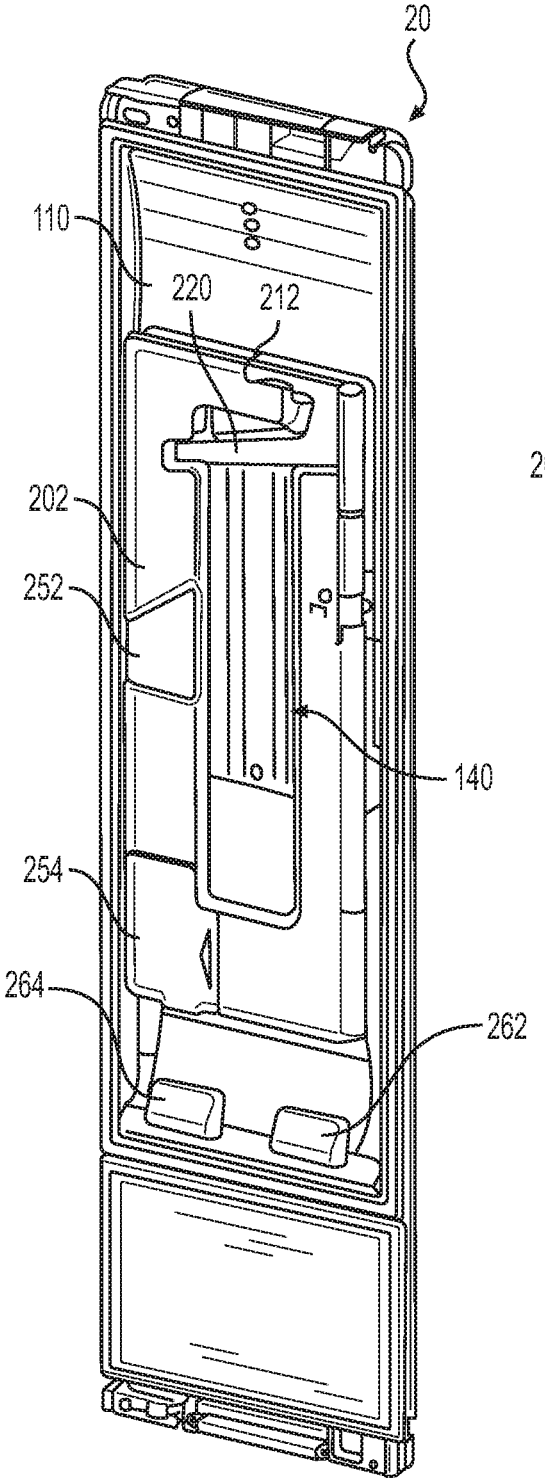
FIG. 2A is a perspective view of a door of the clothes treatment apparatus of FIG. 1 with an exemplary bi-fold panel assembly in a folded configuration before installation of an article of clothing.
Figure 2B:
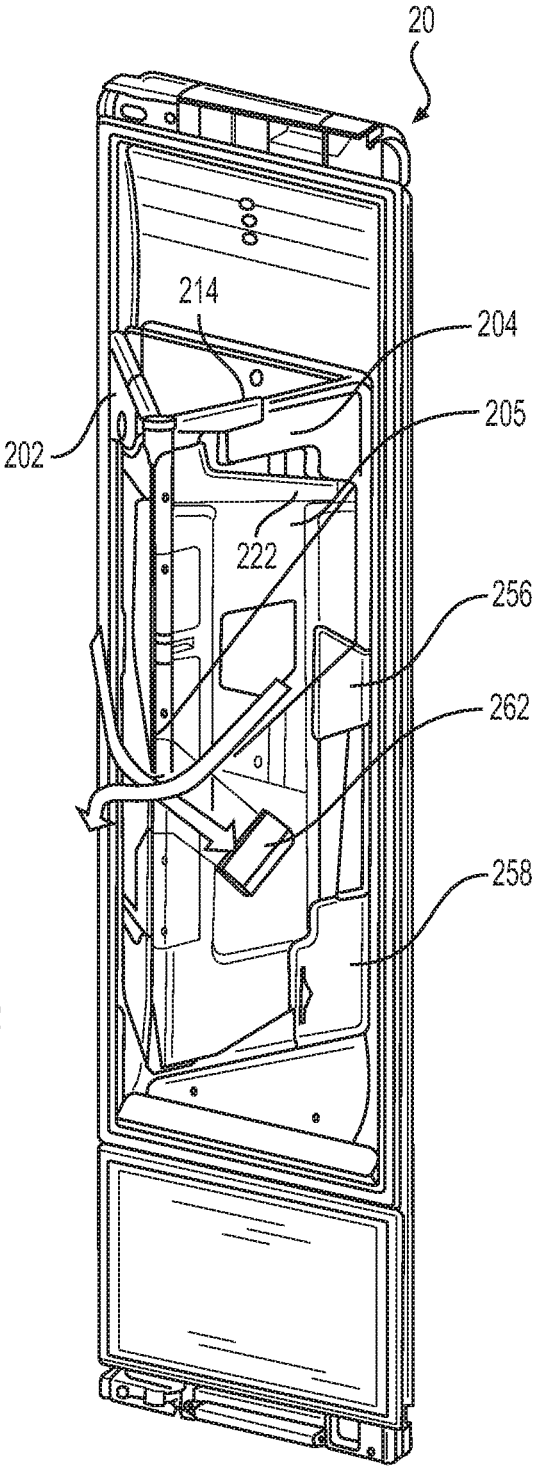
FIG. 2B is a perspective view of the door of FIG. 2A with the bi-fold panel assembly in a tensioning configuration after installation of a first article of clothing.

Wrinkle removal module 100, including bi-fold panel assembly 140, is described in greater detail below with reference to FIGS. 2-13. FIG. 2A shows an exemplary embodiment of bi-fold panel assembly 140 pivotally mounted on door 20 in a folded, overlapping configuration and pivoted against base plate 110, with a front panel 202 and a rear panel 204 (partially hidden in FIG. 2A and positioned between front panel 202 and door 20) of bi-fold panel assembly 140 overlapping each other, with the rear panel positioned against base plate 110. FIG. 2B shows the exemplary embodiment of FIG. 2A in a partially unfolded, "tensioning" configuration with front panel 202 pivoted to form an acute included angle with rear panel 204, and with a first article of clothing such as a shirt 205 mounted and clamped on the front and rear panels of bi-fold panel assembly 140. Although a shirt is shown mounted on front and rear panels 202, 204, other types of clothing or fabric items such as jackets, sweaters, vests, dresses, etc. may be installed on the panels or on base plate 110 for tensioning and/or compression, and exposure to hot air, steam, or cooled and conditioned air within treatment chamber 12.

In the exemplary embodiments illustrated in FIGS. 2A and 2B, front panel 202 includes a left-hand side hanger 220 mounted to upper portion 212 of front panel 202, and rear panel 204 includes a right-hand side hanger 222 mounted to upper portion 214 of rear panel 204. In other embodiments, front panel 202 may include a right-hand side hanger and rear panel 204 may include a left-hand side hanger, depending on varying folded and unfolded configurations. For example, in some alternative implementations, bi-fold panel assembly 140 may be installed on door 20 with front panel 202 pivotally mounted along a proximal side edge to a right-hand side of door 20 rather than a left-hand side of door 20 as viewed in FIGS. 2A and 2B, with rear panel 204 pivotally mounted along a distal side edge of front panel 202. In either implementation, rear panel 204 may be pivoted to and from a folded and overlapping position along a backside of front panel 202 such that rear panel 204 is positioned in between front panel 202 and door 20 when bi-fold panel assembly 140 is pivoted against base plate 110 on door 20.

Front panel 202 may include clips 252 and 254 mounted along one side edge of front panel 202, such as along a proximal side edge of front panel 202, and rear panel 204 may include clips 256 and 258 mounted along one side edge of rear panel 204, such as along a distal side edge of rear panel 204. The clips may be used to clamp on portions of an article of clothing or other fabric item mounted along contiguous mounting surfaces of the front and rear panels, and hold the article of clothing or other fabric item as the front and rear panels are pivoted relative to each other into a tensioning configuration. The clips for clamping on portions of an article of clothing or other fabric item may include or be replaced with other structures configured for holding portions of the article, such as magnetic plates, hook-and-loop fasteners, hook-and-pile fasteners, and other touch fasteners. Reference to "clips" throughout this application will be understood to encompass the afore-mentioned and other structural components that enable temporarily holding portions of articles of clothing or other fabric items during the tensioning and/or compression functions performed by the various disclosed embodiments of wrinkle removal modules. In other embodiments, front panel 202 may include additional clips mounted along a side edge of front panel 202, such as clips 253, 254, and 255, and rear panel 204 may include additional clips mounted along a side edge of rear panel 204, such as clips 257, 258, and 259, as further illustrated in FIGS. 4C, 4D, and 4F. The clips mounted along the side edges of front and rear panels 202, 204 may exert tensioning forces on the article of clothing they clamp to the front and rear panels as the panels are pivoted relative to each other in a direction away from the mounting surfaces of the front and rear panels. The tensioning forces may be directed in opposite, substantially horizontal directions as front panel 202 is pivoted relative to rear panel 204.

Tensioner clips, such as 262 and 264, may be provided for clipping onto a portion of an article of clothing and holding it while exerting a tensioning force onto the portion of the article of clothing as the article of clothing is moved into a tensioning configuration by pivoting front panel 202 and rear panel 204 relative to each other. Tensioner clips 262, 264 may also exert a tensioning force onto an article of clothing as the article of clothing is subjected to a compression force by pressing bi-fold panel assembly 140 against base plate 110 with the article of clothing positioned in between rear panel 204 of bi-fold panel assembly 140 and base plate 110. Tensioner clips 262, 264 may be provided on a lower section of door 20, or anchored at different locations on door 20, bi-fold panel assembly 140, or within cabinet 10, as illustrated in FIGS. 2A and 2B. For example, tensioner clips 262, 264 may be clamped on ends of the sleeves of shirt 205 after crossing the left sleeve over to the right side of the shirt and crossing the right sleeve over to the left side of the shirt when mounting shirt 205 along the mounting surfaces of front panel 202 and rear panel 204 with the front and rear panels in a substantially coplanar configuration before pivoting the front and rear panels to the tensioning configuration illustrated in FIG. 2B. In some exemplary embodiments, tensioner clips 262, 264 may be cable rewound tensioner clips with internal coiled springs contained in a base portion attached through cable extensions to clips such that a tension force applied by the clips to portions of an article of clothing may be redirected by anchoring the base portion at different locations on door 20, bi-fold panel assembly 140, or within cabinet 10. In the exemplary implementation shown in FIG. 2B, base portions (not shown) of cable rewound tensioner clips 262, 264 may be anchored along a lower portion of a distal side edge of rear panel 204 and along a lower portion of a proximal side edge of front panel 202, respectively. In this configuration, each clip 262, 264 exerts a tension force substantially aligned with the direction of the sleeve to which the clip is clamped.

Upper clips 252, 256 clamped on the material of shirt 205 at the intersections of each side of the shirt and respective sleeves may be provided with an angled configuration, e.g., a top edge that is diagonal (approximately 30 degrees-60 degrees to horizontal), in order to assist with the crossing of each sleeve to the opposite side of the shirt while avoiding the creation of any wrinkles in the shirt. The crossing of the sleeves also enables the sleeves of the shirt to be tensioned along with the rest of the shirt as front panel 202 and rear panel 204 are pivoted relative to each other to the tensioning configuration shown in FIG. 2B with front panel 202 positioned at approximately 60 degrees relative to rear panel 204. Alternative implementations of the tensioning function of bi-fold panel assembly 140 may include pivoting front panel 202 relative to rear panel 204 to other included angles besides an included angle of 60 degrees, depending on the width of door 20, the width of the opening into treatment chamber 12, and the size of the article of clothing being tensioned on bi-fold panel assembly 140.

Figure 3A:
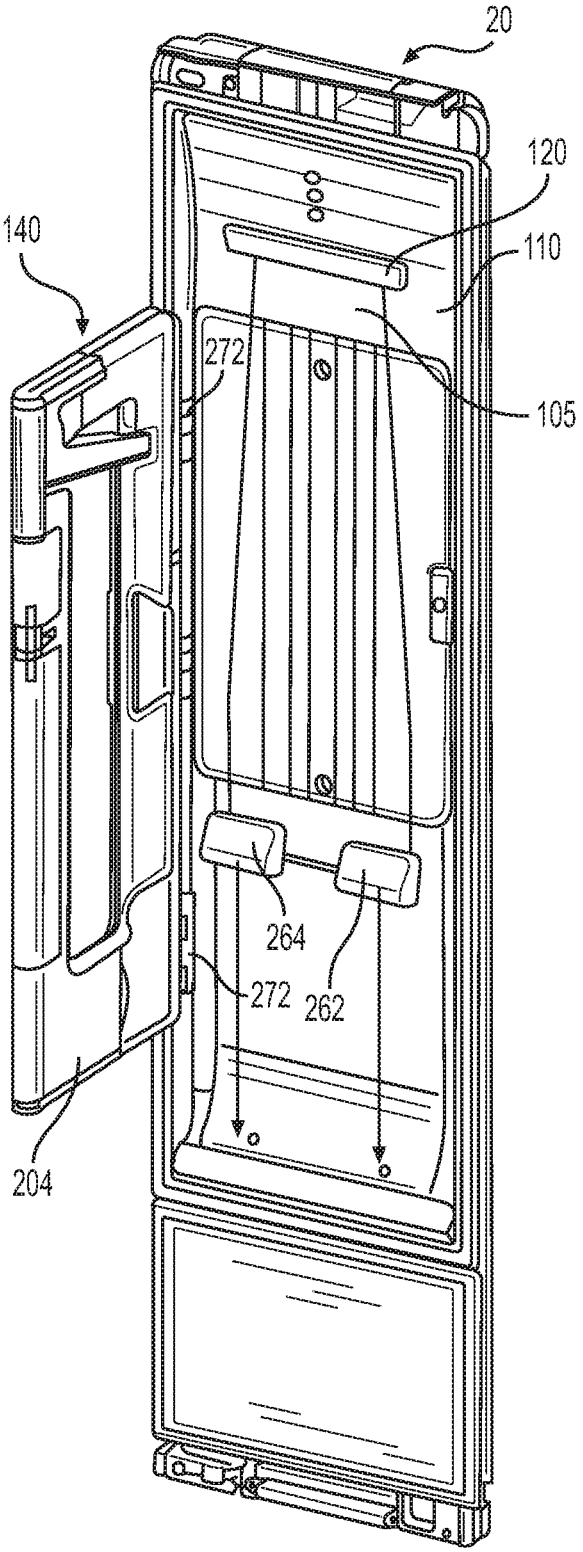
FIG. 3A is a perspective view of the door of the clothes treatment apparatus of FIG. 1 with an exemplary bi-fold panel assembly pivoted open before pressing against a second article of clothing.
Figure 3B:
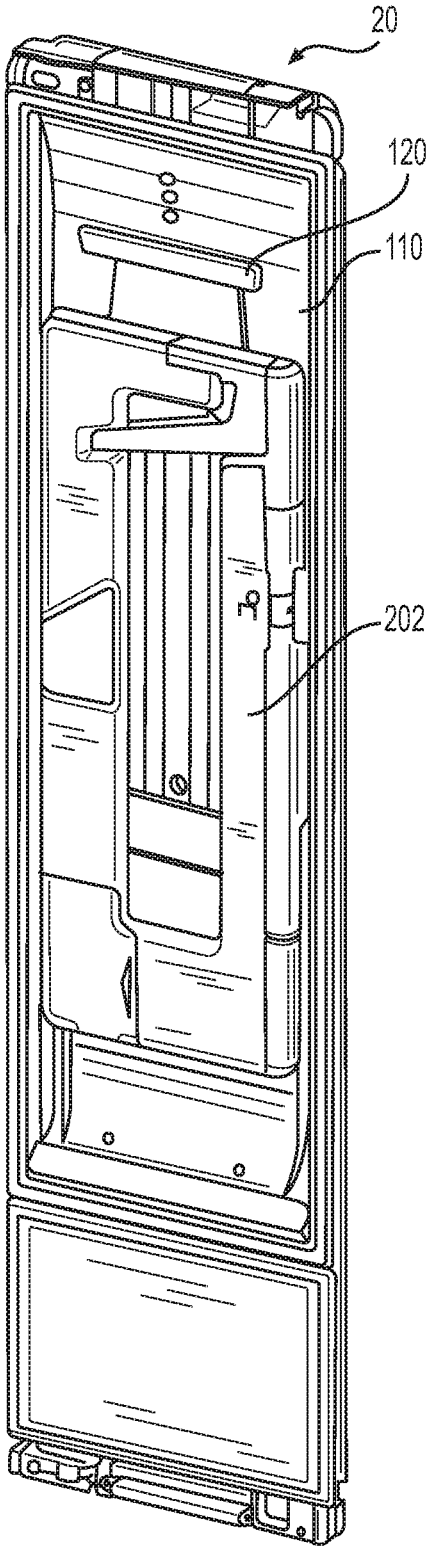
FIG. 3B is a perspective view of the door of FIG. 3A with the bi-fold panel assembly pivoted closed to compress the second article of clothing against a base plate on the door.

FIG. 3A shows an exemplary embodiment of bi-fold panel assembly 140 on door 20 with front and rear panels 202, 204 arranged in a folded, overlapping configuration and pivoted away from base plate 110, with a second article of clothing such as trousers 105 clamped on base plate 110. FIG. 3B shows an exemplary embodiment of bi-fold panel assembly 140 on door 20 in a folded configuration and pivoted against base plate 110, with rear panel 204 of bi-fold panel assembly 140 pressing against trousers 105. Other articles of clothing or fabric items in need of wrinkle removal, such as shorts, scarves, pillow cases, sheets, decorative panels of fabric, placemats, etc. may also be installed and clamped on base plate 110 for compression by bi-fold panel assembly 140 and exposure to hot air, steam, or conditioned and cooled air when door 20 with base plate 110 and bi-fold panel assembly 140 are closed against cabinet 10 and positioned inside treatment chamber 12.

In one exemplary implementation, as shown in FIGS. 3A and 3B, bi-fold panel assembly 140 may be configured to be pivoted into contact with base plate 110 for pressing an article of clothing such as trousers 105 positioned between bi-fold panel assembly 140 and base plate 110. Bi-fold panel assembly 140 may be pivotally connected to door 20 or to a side edge of base plate 110 by one or more side hinges 272 disposed along a proximal side edge of front panel 202. In an alternative embodiment, rear panel 204 of bi-fold panel assembly 140 may be pivotally connected by one or more side hinges along a proximal edge of the rear panel to door 20 or directly to a side edge of base plate 110, and front panel 202 may be connected by one or more central hinges along a distal edge of rear panel 204. In still further alternative embodiments, as discussed above, front panel 202 or rear panel 204 may be pivotally connected to door 20 at a right-hand side of door 20 rather than the left-hand side of door 20 as shown in FIGS. 3A and 3B. In such alternative embodiments, front panel 202 may be pivoted to lie flat against rear panel 204 in a folded, overlapping configuration of bi-fold panel assembly 140 and extended to a position in which front panel 202 and rear panel 204 are substantially contiguous and approximately coplanar. In any of the above-described embodiments, when bi-fold panel assembly 140 is folded with front panel 202 and rear panel 204 overlapping and lying flat against each other, a rear surface of rear panel 204 may be pivoted into close proximity with base plate 110 during a compression operation with an article of clothing such as trousers 105 pressed in between rear panel 204 and base plate 110.

In the exemplary embodiments illustrated in FIGS. 3A and 3B, hanger member 120 may be provided for hanging an article of clothing or other fabric item to be compressed against base plate 110 on door panel 22 of door 20. The shape of hanger member 120 may be modified to hang various types of clothing or other fabric items, such as scarves, mufflers, pillow cases, and placemats, in addition to trousers. Trousers 105 may be hung from hanger member 120 configured to clip firmly onto one end of the trousers, such as at the cuff end. In this exemplary implementation, tensioner clips 262, 264 may be positioned at a lower portion of door panel 22 and clipped onto a portion of trousers 105 at the opposite end of the trousers from the end clipped by hanger member 120, e.g., a waist band. Tensioner clips 262, 264 may be weighted, or connected via one or more biasing members to a lower portion of door panel 22 in order to subject trousers 105 to a tension force in a direction essentially parallel to an inseam of the trousers while the trousers are compressed in between bi-fold panel assembly 140 and base plate 110 and exposed to hot air, steam, and/or conditioned and cooled air within treatment chamber 12, thereby eliminating wrinkles in the trousers. In the exemplary implementation shown in FIG. 3A, base portions (not shown) of lower cable rewound tensioner clips 262, 264 may be anchored near the bottom of base plate 110 such that the clips exert a substantially vertically downward force on trousers 105. In an alternative implementation, such as when applying tension to sleeves of a shirt, as shown in and described above with respect to FIG. 2B, base portions of lower cable rewound tensioner clips 262, 264 may be anchored to side portions of door 20 or bi-fold panel assembly 140 such that the tension force exerted by the clips is redirected in a sideways and downward direction.

Bi-fold panel assembly 140 may be pivoted to a pressing position with trousers 105 pressed in between rear panel 204 of bi-fold panel assembly 140 and base plate 110. In some implementations, clothes may be brought into uniform and close contact with base plate 110 by an elastic force provided by bi-fold panel assembly 140. In other implementations, base plate 110 may be manufactured from a single, flexible, and deformable plate. In still further alternative implementations, such as discussed above, base plate 110 may be manufactured from an assembly of a plurality of plates or segmented plates. A groove may also be formed in a portion of base plate 110 at which a hem of trousers 105 is located when clamping trousers 105 to base plate 110. As a result, interference between base plate 110 and the hem of trousers 105 may be avoided during compression of trousers 105, and the contact area between base plate 110 and trousers 105 may be maximized. When base plate 110 is pressed by bi-fold panel assembly 140 during a trousers pressing operation, base plate 110 may be rotated or twisted about fastening parts 113 (shown in FIG. 1) by a predetermined angle. As a result, rear panel 204 of bi-fold panel assembly 140 is brought into uniform contact with base plate 110. In some implementations, when bi-fold panel assembly 140 is rotated from left to right in a state in which trousers 105 are located between base plate 110 and the rear panel of bi-fold panel assembly 140, left elastic base part 115 is pressed first, and then right elastic base part 116 is pressed. In some implementations, elastic base part 115, 116 may be elastically deformed to the left side about fastening parts 113 by a predetermined angle. As a result, the pressure applied to the trousers is distributed and uniformly applied over the trousers.

In some implementations of the disclosed embodiments of this disclosure, bi-fold panel assembly 140 may perform a tensioning function on one article of clothing simultaneously with performing a compression function on a second article of clothing. For example, a shirt may be mounted on front and rear panels 202, 204 pivoted to a substantially coplanar arrangement with door 20 opened from cabinet 10, and then front and rear panels 202, 204 may be pivoted relative to each other all the way back to a folded, overlapped configuration, such as shown in FIGS. 3A, 3B. Over-tensioning of the shirt may be avoided in this completely folded and overlapping configuration of front and rear panels 202, 204 since the shirt clips that are clamped to sides of the shirt allow a small amount of movement of the material of the shirt between a front portion and a rear portion of each shirt clip as tension is applied to the shirt by pivoting front and rear panels 202, 204 relative to each other. With a shirt mounted and clamped along mounting surfaces of front and rear panels 202, 204, and pivoting of the front and rear panels about the central hinges connecting the panels to a completely folded and overlapped configuration, bi-fold panel assembly 140 may then be pivoted into engagement with another article of clothing such as trousers supported against base plate 110 to apply compression against the trousers at the same time as tension is being applied to the shirt.

Figure 4A:
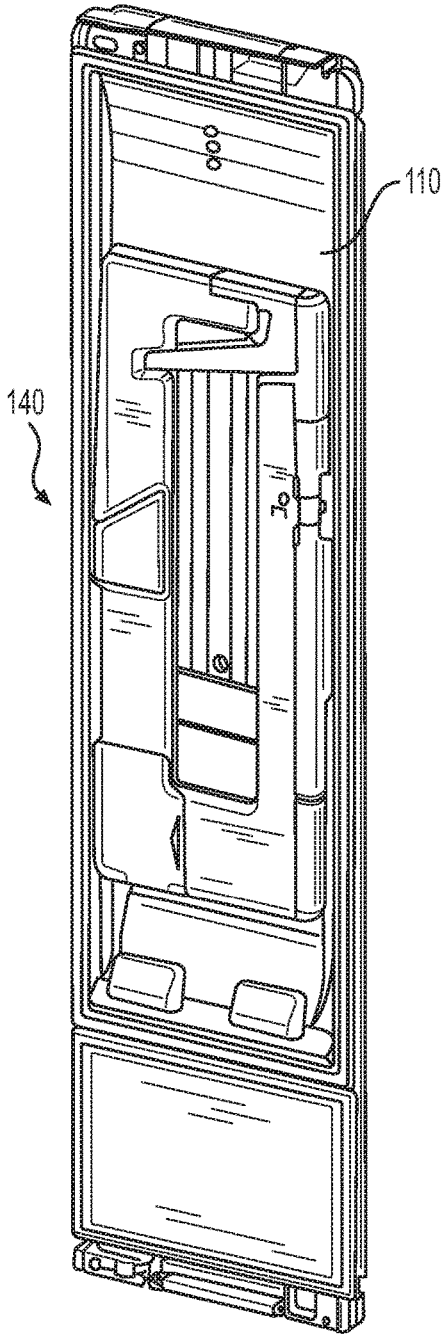
FIGS. 4A and 4B are perspective views of the door and bi-fold panel assembly of the exemplary clothes treatment apparatus of FIG. 1 with the bi-fold panel assembly in a folded, closed configuration and an open, substantially coplanar configuration before installation of an article of clothing.
Figure 4B:
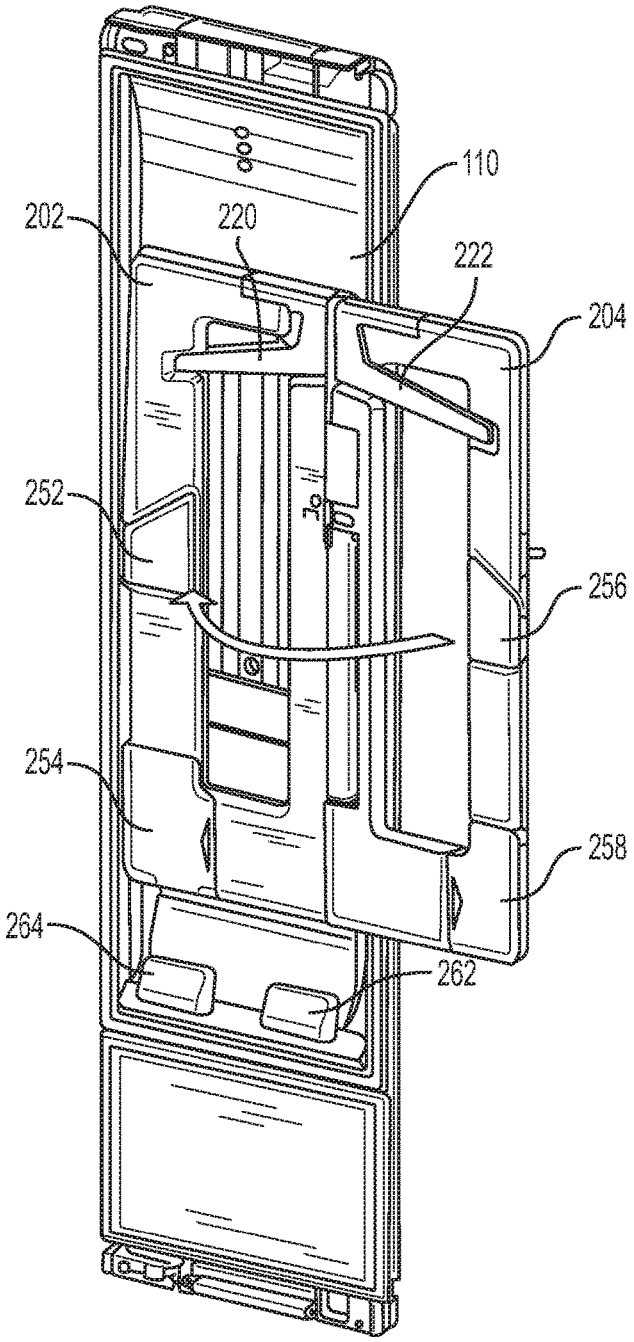
Figure 4D:
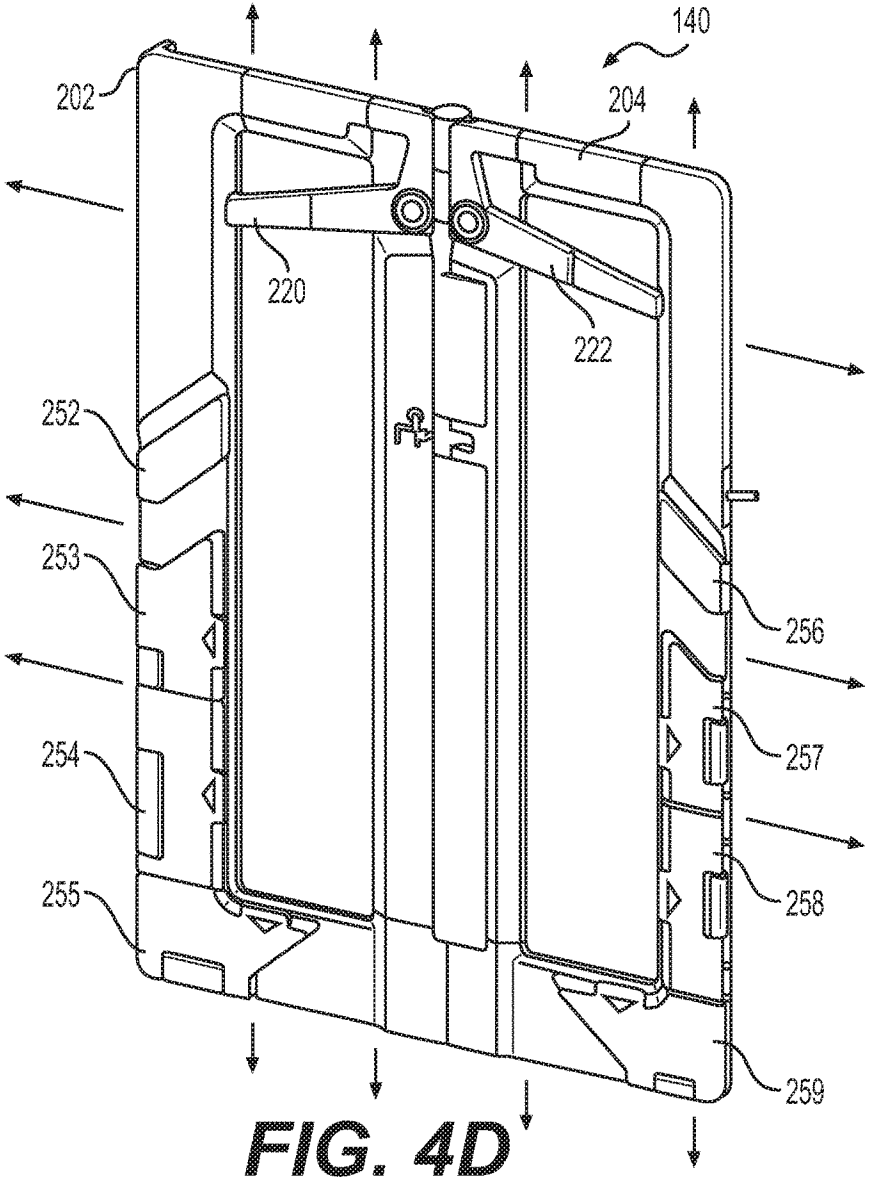
FIGS. 4C and 4D are perspective views of an alternative embodiment of the bi-fold panel assembly of FIGS. 4A and 4B.
Figure 4C:
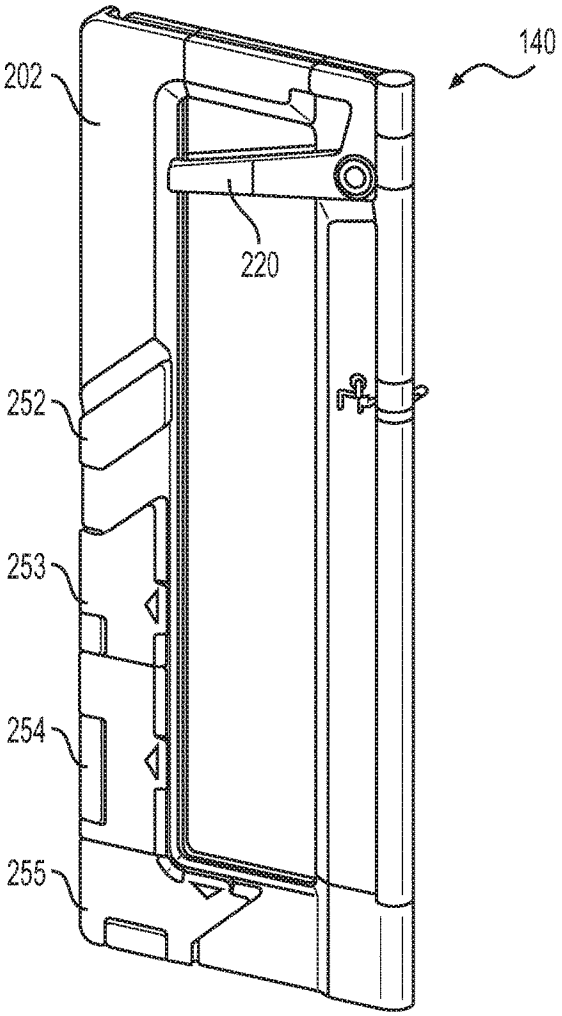

FIG. 4A shows an exemplary embodiment of bi-fold panel assembly 140 on door 20 in a folded configuration and pivoted against base plate 110 when not in use. FIG. 4B shows the exemplary embodiment of FIG. 4A with bi-fold panel assembly 140 unfolded such that front panel 202 and rear panel 204 are arranged in a substantially coplanar and contiguous configuration, ready for the installation of the first article of clothing. FIG. 4C shows another exemplary embodiment of bi-fold panel assembly 140 detached from door 20, in a folded configuration with front panel 202 overlapping rear panel 204, and with a greater number of clips 252, 253, 254, and 255 arranged along a proximal side edge of front panel 202 than shown in the exemplary embodiment of FIG. 4A. FIG. 4D shows the exemplary embodiment of FIG. 4C in an unfolded configuration with front panel 202 substantially coplanar and contiguous with rear panel 204, and with clips 256, 257, 258, and 259 arranged along a distal side edge of rear panel 204. In some embodiments, front panel 202 and rear panel 204 may be adjustable in size to accommodate clothing articles or other fabric items of different sizes, as represented by the arrows in FIG. 4D. A range of overall dimensions for bi-fold panel assembly 140 may be determined by dimensions of door 20 and cabinet 10. Each of front panel 202 and rear panel 204 may include multiple, telescoping members that are interconnected and interlocked to allow the panels to be expanded and contracted between different overall height and width dimensions. In one exemplary implementation, parallel side compression plates 144 of each of front panel and rear panel 204 may include slidable extensions that can be adjusted between overlapping, smaller assembled lengths and widths, and extended, longer assembled lengths and widths, within limits imposed by the overall inside dimensions of cabinet 10 and door 20. In still further alternative embodiments, the entire bi-fold panel assembly 140 may be detachable from door 20 and/or base plate 110 such that bi-fold panel assembly 140, either with an article of clothing installed or when not in use, may be detached from door 20 and/or base plate 110 and hung on hanger support bar 13 in cabinet 10.

In the exemplary embodiments, clip 252 of front panel 202 may be mounted along a proximal side edge of front panel 202 and located to engage on a shirt at a position directly below the intersection of a left sleeve and a left side of the shirt (as viewed from a side facing the side of front panel 202 on which a shirt is mounted). Similarly, clip 256 may be mounted along a distal side edge of rear panel 204 and located to clamp on the shirt at a position directly below the intersection of a right sleeve and a right side of the shirt. In some embodiments, clips 252, 256 may be fixed in dimension and provided with a fixed gap between portions of the clips such that the clips may be slid over respective portions of the shirt with the portions of the shirt retained by the clips. In other embodiments, clips 252, 256 may each include a biasing member such as a spring that allows a front portion of clips 252, 256 to be pulled out from front panel 202 and rear panel 204, respectively, against a biasing force of the biasing member such that the material at the intersection of the left sleeve and the left side of the shirt, and at the intersection of the right sleeve and the right side of the shirt may be inserted between clip 252 and front panel 202, and between clip 256 and rear panel 204, and retained there upon release of the clip. Front panel 202 may include a recess for accommodating a fixed dimension clip 252, or when the clip is in a biased closed configuration such that the front face of clip 252 is substantially flush with or below a front face of front panel 202 when bi-fold panel assembly 140 is in a folded configuration. Similarly, rear panel 204 may include a recess for accommodating clip 256. The recessed configuration of clips 252, 256 on front panel 202 and rear panel 204, respectively, ensures that the front and rear panels can be pivoted into their folded, overlapping configuration for use during compression of an article of clothing such as trousers, while retaining flush pressing surfaces along the compression side plates 144 of the front and rear panels.

Figure 4E:
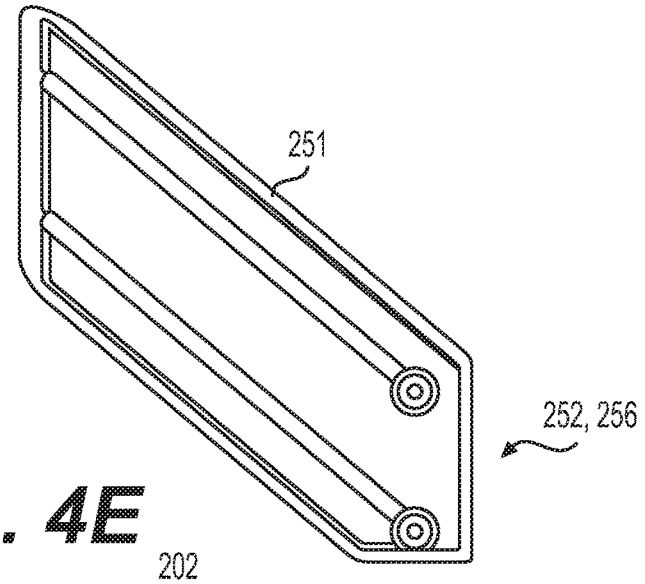
FIG. 4E is a perspective view of a back surface of a portion of a clip from the bi-fold panel assembly of FIGS. 4C and 4D.

FIG. 4E is a rear perspective view of a clip such as clips 252, 256 shown in FIGS. 4C and 4D, showing reinforcing ribs 251 formed along the clips. Each of the lower clips 253, 254, 255, 257, 258, and 259 may include reinforcing ribs similar to ribs 251 shown extending along the back side of an upper clip 252, 256 in FIG. 4E to strengthen the clips and improve the contact between each of the clips and the article of clothing being retained in place on front panel 202 and rear panel 204.

Figure 4F:
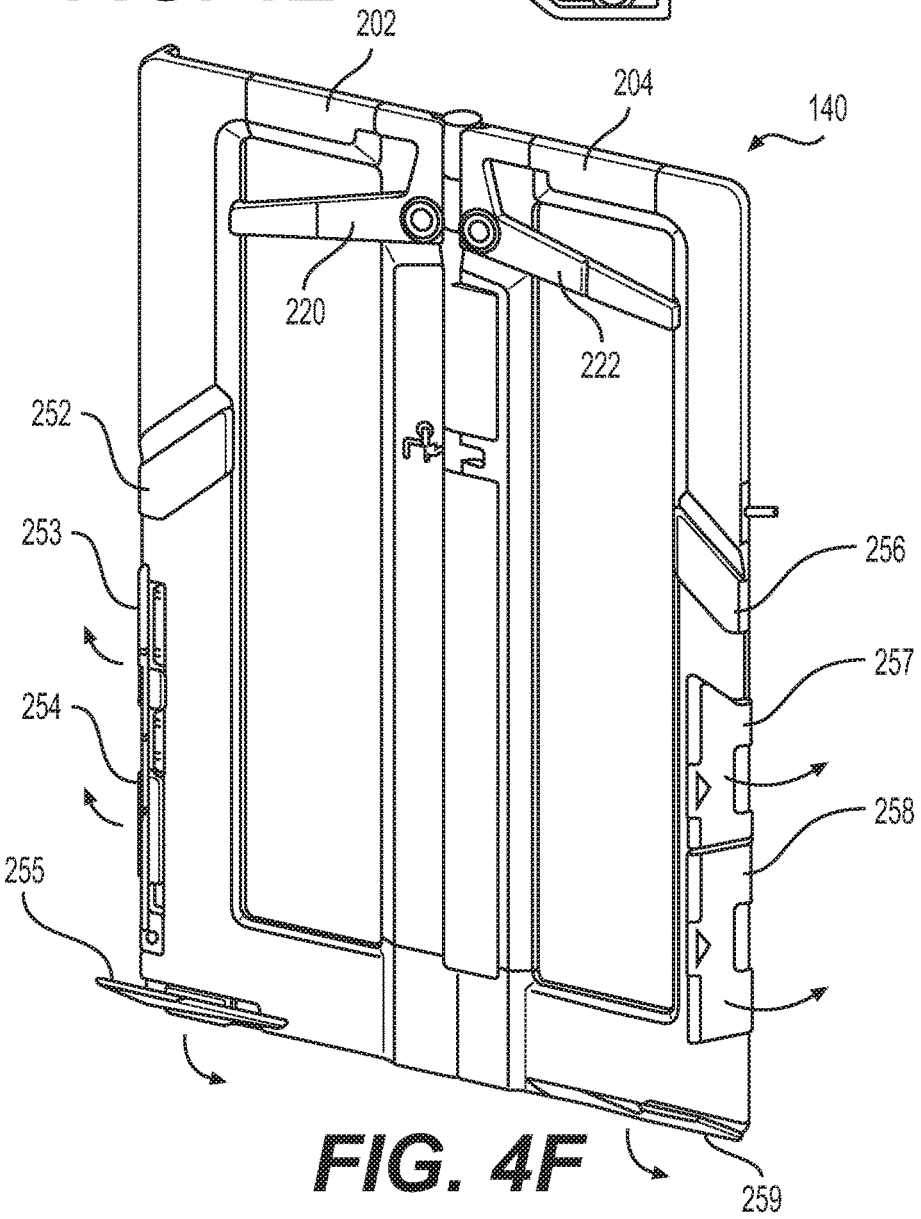
FIG. 4F is a perspective view of the bi-fold panel assembly of FIG. 4D with clips shown in an open configuration.

FIG. 4F shows the exemplary embodiment of bi-fold panel assembly 140 of FIG. 4D with clips 253, 254, 255, 257, 258, and 259 in an open position for loading of the first article of clothing onto bi-fold panel assembly 140. As shown in FIGS. 4C, 4D, and 4F, front panel 202 may additionally include one or more lower clips 253, 254, and 255, and rear panel 204 may additionally include one or more lower clips 257, 258, and 259. Lower clips 253, 254, 255, 257, 258, and 259 may be hinged and spring-loaded to engage and clamp on side portions of a shirt (or other article of clothing or fabric item) and hold the shirt in position as the panels are pivoted relative to each other in order to apply a tension to the shirt for assisting with wrinkle removal. Lower clips 253, 254, and 255 may be positioned to clamp on the shirt at positions near a bottom left side of the shirt. Lower clip 253 may clamp on the shirt at a position directly below the intersection of the left sleeve and the left side of the shirt, lower clip 254 may clamp on the shirt at a position directly below clip 253, and lower clip 255 may clamp on the shirt at a bottom left corner of the shirt, providing support of the shirt in both horizontal and vertical directions Similarly, lower clips 257, 258, and 259 may be positioned to clamp on the shirt at a position near a bottom right side of the shirt. Lower clip 257 may clamp on the shirt at a position directly below the intersection of the right sleeve and the right side of the shirt, lower clip 258 may clamp on the shirt at a position directly below clip 257, and lower clip 259 may clamp on the shirt at a bottom right corner of the shirt, providing support of the shirt in both horizontal and vertical directions. Lower clips 253, 254, 255, 257, 258, and 259 may include biasing members that allow front portions of lower clips 254, 258 to be pulled out from front and rear panels 202, 204, respectively, against a biasing force of the biasing members such that the material at the sides of the shirt may be inserted between lower clips 253, 254, 255 and front panel 202, and between lower clips 256, 257, 258 and rear panel 204, and retained there upon release of the clips.

Figure 4G:
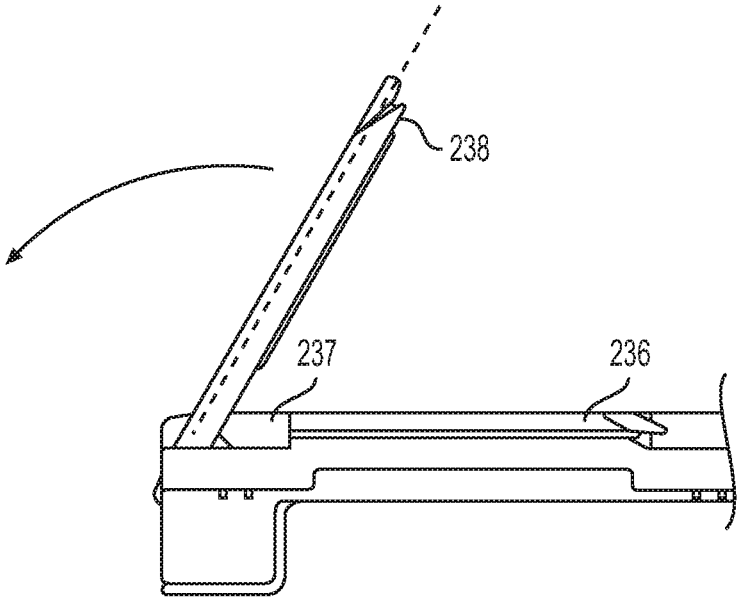
FIG. 4G is a detailed view of one of the clips of FIG. 4F in an opened configuration.
Figure 4H:
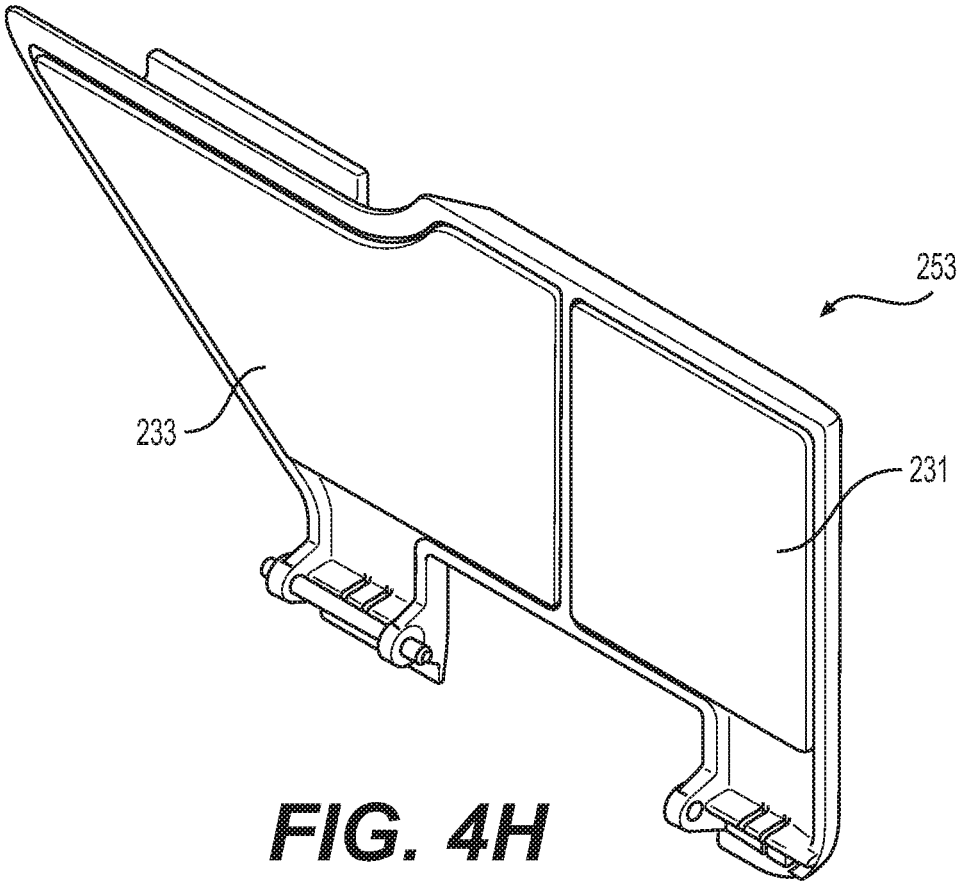
FIG. 4H is a perspective view of a back side of a portion of a clip showing details of non-slip pads.

As shown in FIG. 4G, each of clips 253, 254, 255, 257, 258, and 259 may also include a bump-out locking feature 237 that allows a front portion 238 of the clip to be retained temporarily in an open position relative to a back portion 236 against a biasing force of a spring or other biasing member. The clips can be released and closed, with a portion of an article of clothing clamped in between front portion 238 and rear portion 236 when a user applies a small amount of force to over-ride the bump-out locking feature. As further shown in FIG. 4H, each of clips 252, 253, 254, 255, 256, 257, 258, and 259 may also include one or more rubber pads 231, 233 or other gripping material that prevents slippage and misalignment of the shirt as bi-fold panel assembly 140 is pivoted to the tensioning configuration as shown, for example, in FIG. 2B.

Figure 5A:
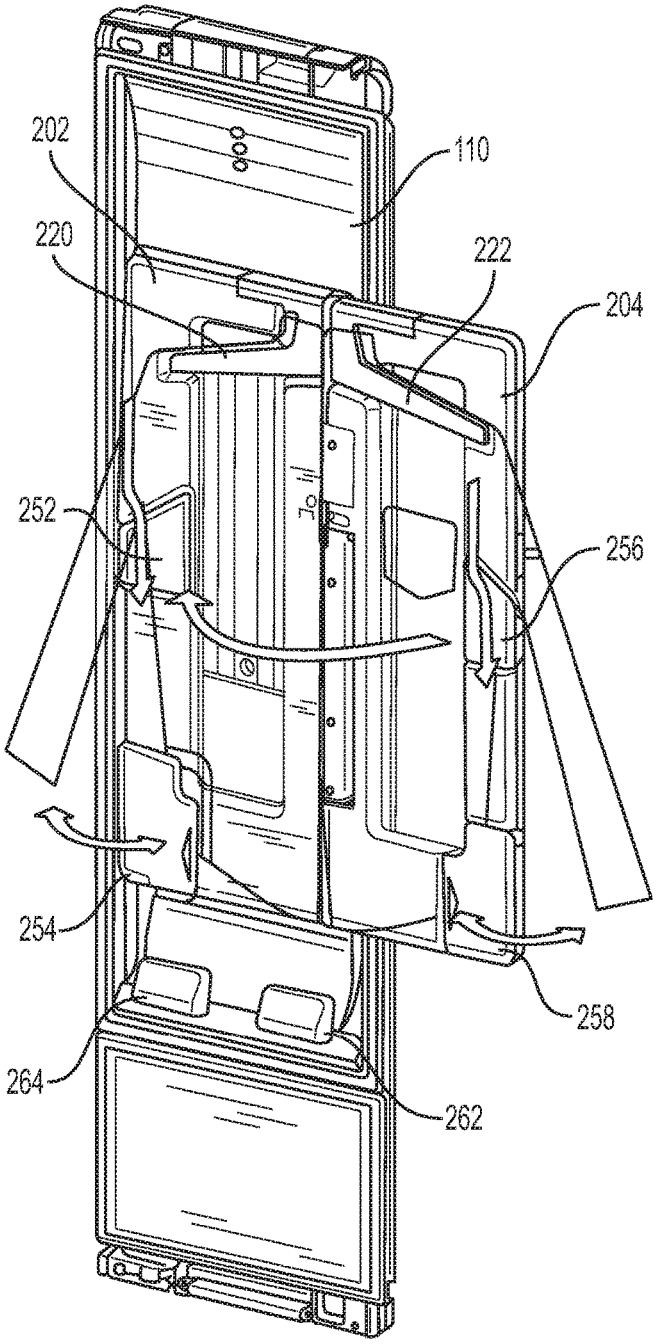
FIGS. 5A and 5B are perspective views of the door and bi-fold panel assembly of FIGS. 4A and 4B after installation and tensioning of an article of clothing.
Figure 5B:
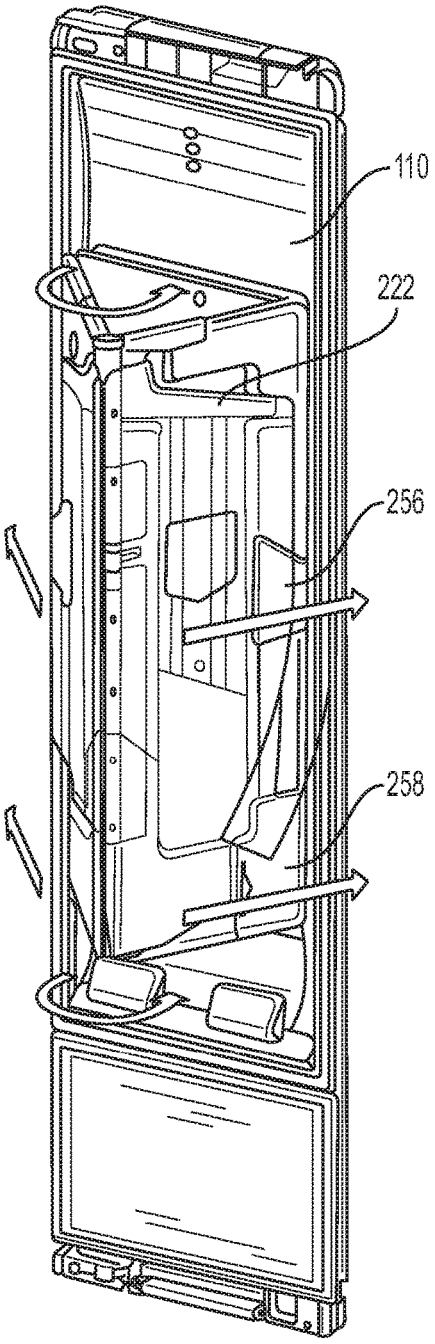

FIG. 5A shows a bi-fold panel assembly mounted on a door with front panel 202 and rear panel 204 in an unfolded and substantially coplanar configuration, with a first article of clothing such as a shirt installed on a left-hand side hanger 220 of front panel 202 and a right-hand side hanger 222 of rear panel 204. FIG. 5B shows front panel 202 and rear panel 204 pivoted relative to each other in a direction away from the side of the panels on which the shirt is mounted to a substantially triangular, tensioning configuration. The arrows in FIG. 5B illustrate the directions of substantially horizontal tensioning forces that may be applied to the first article of clothing by clips 252, 254 on a proximal side edge of front panel 202 and clips 256, 258 on a distal side edge of rear panel 204 as the front and rear panels are pivoted relative to each other from the substantially coplanar configuration of FIG. 5A to the triangular, tensioning configuration of FIG. 5B.

Figure 6A:
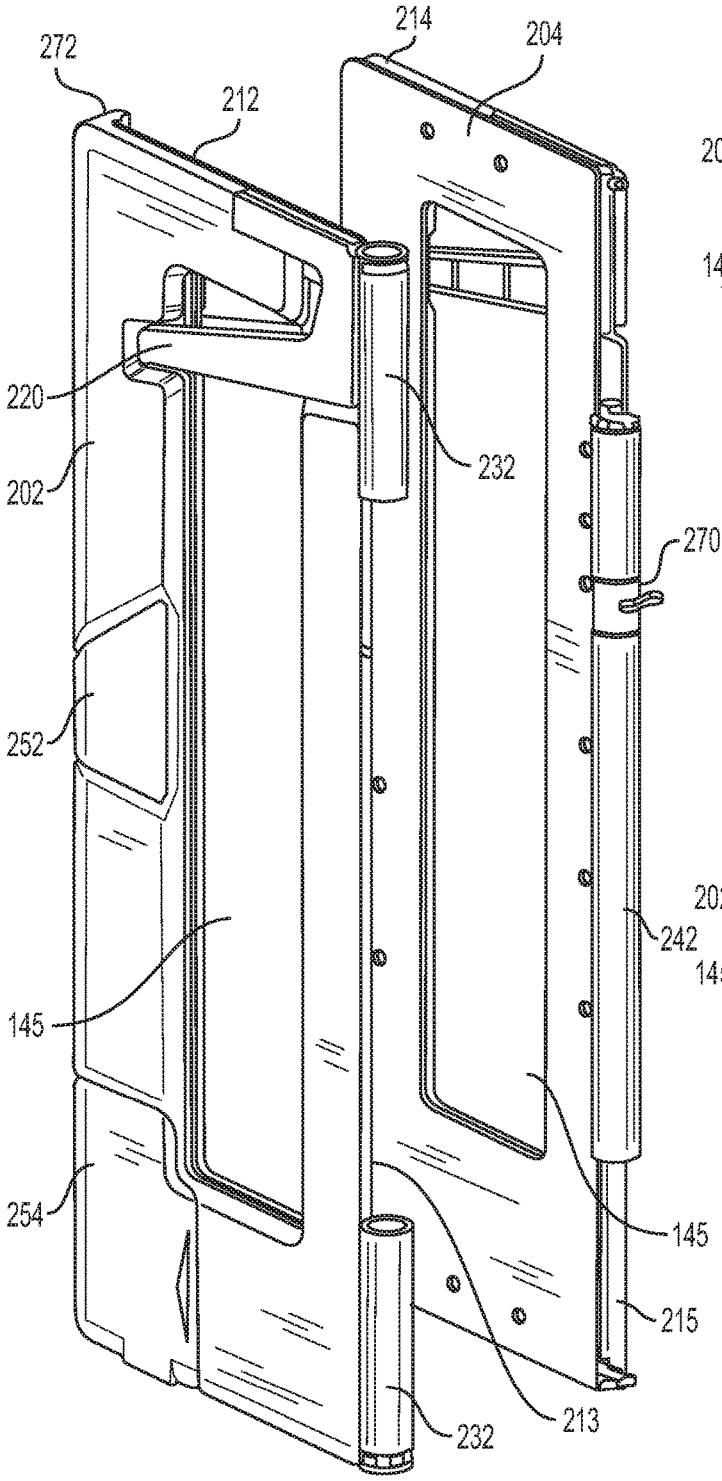
FIGS. 6A and 6B are perspective views of an exemplary bi-fold panel assembly removed from the door of the clothes treatment apparatus of FIG. 1, illustrating details of the hinged connection between the panels.
Figure 6B:
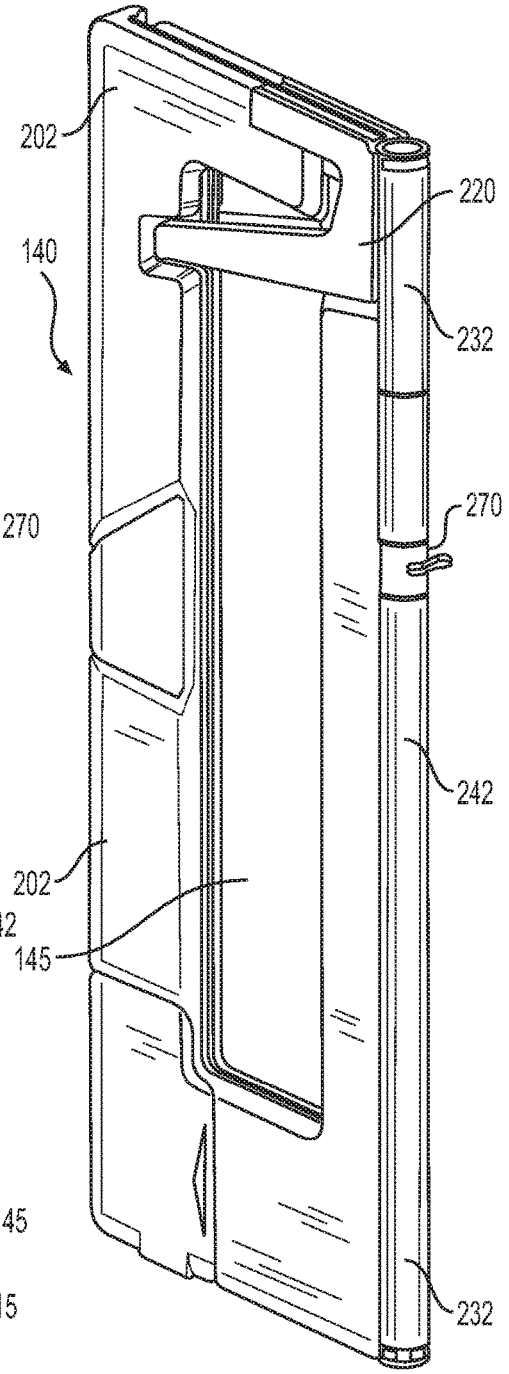

FIG. 6A shows an exemplary embodiment of a bi-fold panel assembly 140 in a disassembled configuration, with front and rear panels 202, 204 and associated central hinges 232, 242 separated from each other. FIG. 6B shows the exemplary embodiment of 6A with front panel 202 pivotally connected to rear panel 204 by central hinges 232, 242 along a distal side edge 213 of front panel 202 and a proximal side edge 215 of rear panel 204. Central hinge 242 may include a central hinge interlock 270 at an intermediate position along its length. Both front panel 202 and rear panel 204 may include a central opening, such as opening 145, as shown in FIGS. 6A and 6B, to allow hot air, steam, or conditioned and cooled air to reach an article of clothing or other fabric item mounted and clipped along mounting surfaces of the front and rear panels during a tensioning operation, and to reach an article of clothing mounted along base plate 110 on door 20 of cabinet 10 while applying compression to the article of clothing positioned in between bi-fold panel assembly 140 and base plate 110 during a compression operation.

Figure 7:
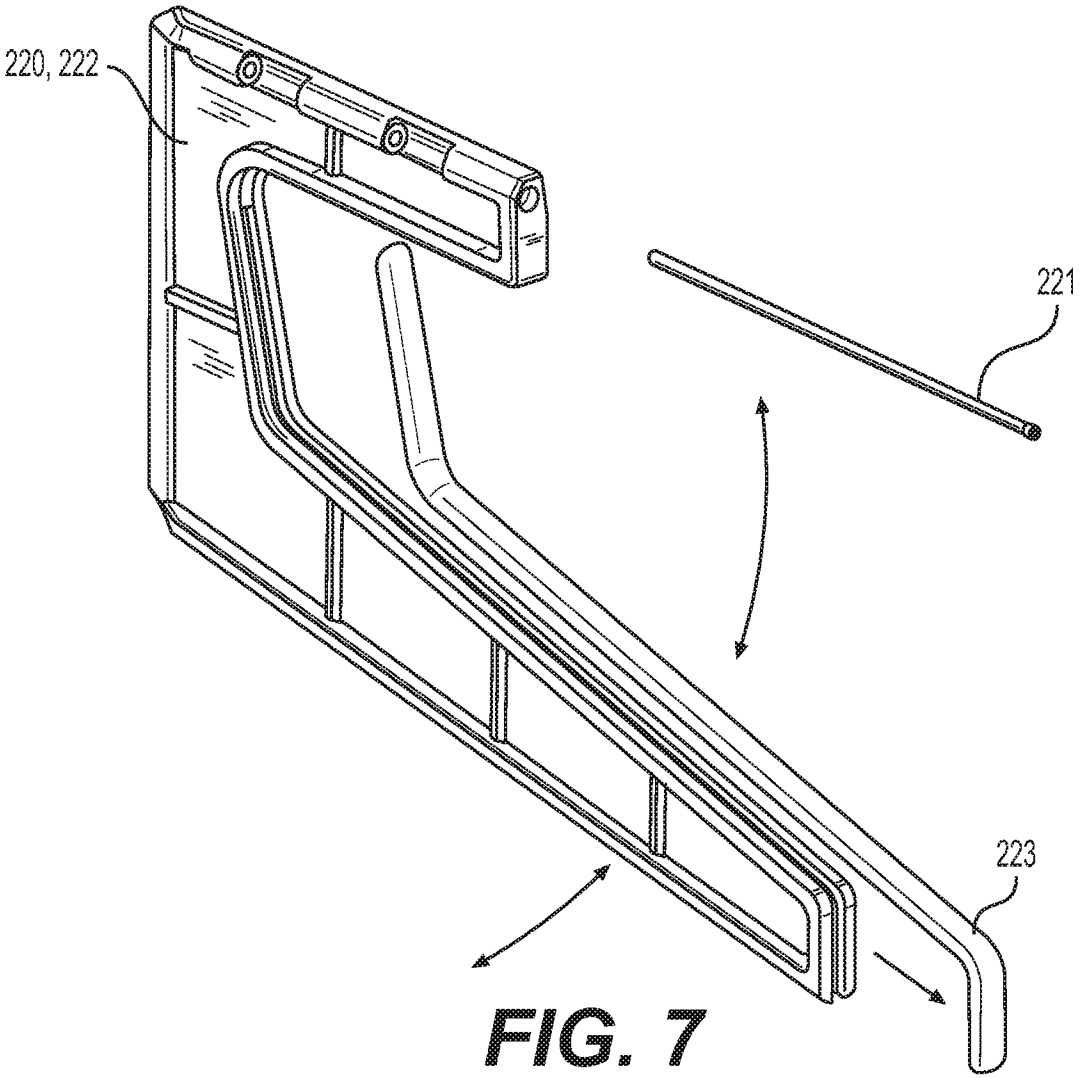
FIG. 7 is a perspective view of an exemplary, adjustable clothes hanger from the clothes treatment apparatus of FIG. 1.

FIG. 7 is a detailed perspective view of an exemplary, adjustable hanger half, such as left-hand side hanger 220, or right-hand side hanger 222. Each of hangers 220, 222 may be pivotally mounted with a corresponding hanger hinge pin 221 to upper portions 212, 214 (see FIGS. 2A and 2B) of respective front and rear panels 202, 204. Each hanger 220, 222 may also include a hanger rubber bead 223 designed to prevent slippage between the shirt and the hanger and keep the shirt in a central, symmetrically arranged position relative to front panel 202 and rear panel 204. In some embodiments, each of hanger 220, 222 may be adjustable in the angle and length of the hangers to accommodate different shoulder profiles and shapes of the articles of clothing that are installed on the hangers of bi-fold panel assembly 140. In other embodiments, each of hanger 220, 222 may be detachable and replaced with a hanger with a different shape, size, or arm angle as to accommodate an article of clothing with a different type, shape, fabric, or size.

FIGS. 8A, 8B, 8C, and 8D show an exemplary embodiment of a door 20 with a wrinkle removal module including a bi-fold panel assembly pivotally mounted to door 20 and base plate 110, and illustrating sequential stages during the mounting and clamping of a first article of clothing such as shirt 205 to one side of front panel 202 and rear panel 204, pivoting of front panel 202 relative to rear panel 204 in a direction away from the side of the panels on which the shirt is mounted to a tensioning configuration, and closing of the bi-fold panel assembly with the first article of clothing in the tensioning configuration into the cabinet such that the first article of clothing can be treated inside treatment chamber 12.

In a shirt tensioning sequence illustrated in FIGS. 8A-8D, bi-fold panel assembly 140 may be unfolded to a configuration in which front panel 202 and rear panel 204 are substantially coplanar, hangers 220, 222 may be pivoted forwardly from their respective recesses in front panel 202 and rear panel 204, shirt 205 may be hung on hangers 220, 222 and buttoned up, clips 252, 253, 254, 255, 256, 257, 258, 259, 262, and 264 may be clamped onto the sides and sleeves of the shirt, and front and rear panels 202, 204 may be pivoted relative to each other to an included angle of approximately 60 degrees, or some other included angle as discussed above. The process of pivoting front panel 202 relative to rear panel 204 after shirt 205 is mounted and clamped on bi-fold panel assembly 140 applies tension to the shirt in a substantially horizontal direction and in a direction along the sleeves. The tension is a result of the radii of central hinges 232, 242, joining front panel 202 to rear panel 204. As front panel 202 and rear panel are pivoted relative to each other in a direction away from the sides of the panels on which the shirt is mounted, the radii of central hinges 232, 242 increases the distance between the outer side edges of front and rear panels 202, 204. The clips position and fix the shirt to bi-fold panel assembly 140 during the tensioning sequence, and avoid the creation of any unwanted creases.

Figure 9:
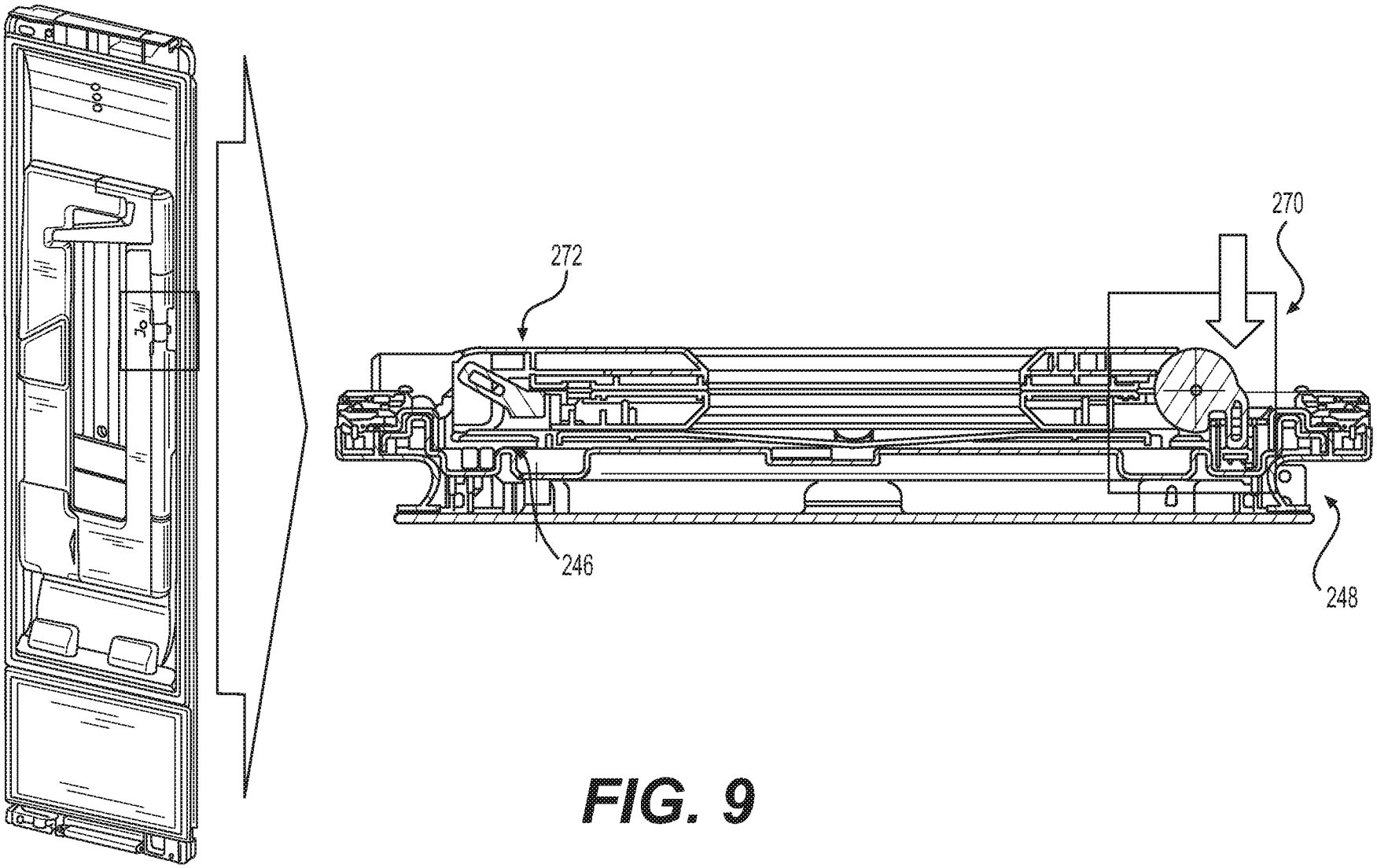
FIG. 9 includes a perspective view and enlarged top plan view of the door and bi-fold panel assembly of the clothes treatment apparatus of FIG. 1 with the bi-fold panel assembly closed and latched to the door.
Figure 10:
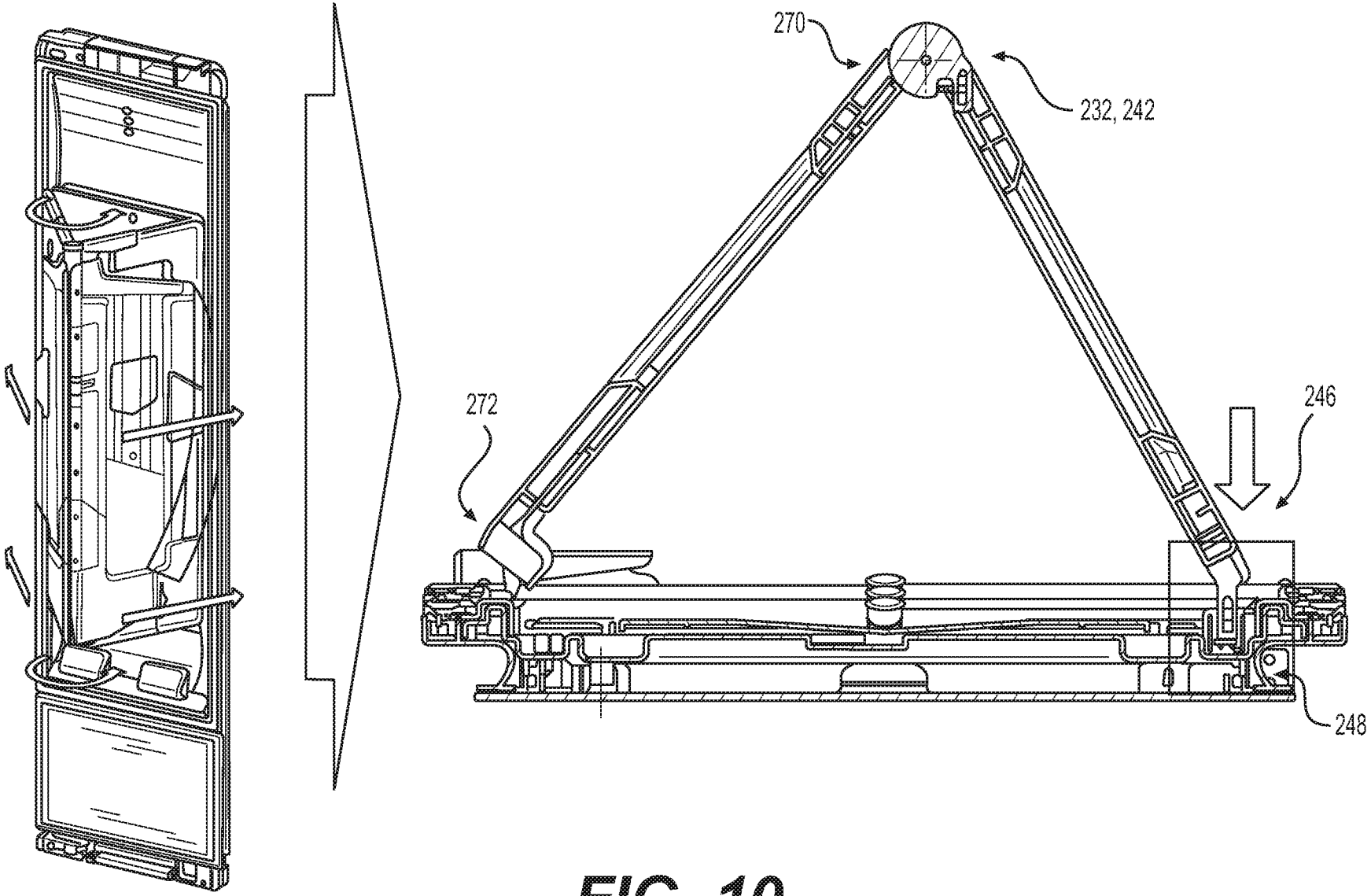
FIG. 10 includes a perspective view and enlarged top plan view of the door and bi-fold panel assembly of the clothes treatment apparatus of FIG. 1 with the bi-fold panel assembly in a tensioning configuration.

FIG. 9 includes a perspective view and enlarged top plan view of the door and bi-fold panel assembly of the clothes treatment apparatus of FIG. 1 with the bi-fold panel assembly closed and latched to the door. FIG. 10 includes a perspective view and enlarged top plan view of the door and bi-fold panel assembly of the clothes treatment apparatus of FIG. 1 with the bi-fold panel assembly in a tensioning configuration. As illustrated in FIG. 9, front panel 202 and rear panel 204 may be retained in an overlapped, parallel configuration when not being used to style a shirt, such as when bi-fold panel assembly 140 is used for pressing trousers 105 between rear panel 204 and base plate 110. Central hinge interlock 270 may include an extending latch feature, which is a protrusion that engages with a door catch assembly 248 on door 20 when the shirt tensioning function of bi-fold panel assembly 140 is not being used or when bi-fold panel assembly 140 is used for pressing trousers 105 as illustrated in FIGS. 3A and 3B, in order to maintain bi-fold panel assembly 140 in a folded configuration against base plate 110.

Rear panel 204 may be pivoted relative to front panel 202 from an overlapping position in which rear panel 204 lies flat against front panel 202, as shown in FIG. 9, to an unfolded and extended position in which front panel 202 and rear panel 204 are approximately coplanar. In this exemplary embodiment, front panel 202 and rear panel 204 may be pivoted relative to each other about central hinges 232, 242 to the substantially coplanar orientation for the mounting and clamping of a clothing article or other fabric item along mounting surfaces of front and rear panels 202, 204. After mounting and clamping of the clothing article or other fabric item, front panel 202 and rear panel 204 may be pivoted relative to each other in a direction away from the mounting surfaces into the clothes tensioning position shown in FIG. 10. A rear panel secondary interlock 246 at a distal side edge of rear panel 204 may include an extending latch feature configured to engage with catch assembly 248 when front panel 202 and rear panel 204 are rotated to the tensioning configuration, as illustrated in FIG. 10. The engagement of rear panel secondary interlock 246 with catch assembly 248 retains the panels in the substantially triangular tensioning configuration shown in FIG. 10 as door 20 is closed and shirt 205 or other clothing article or fabric item mounted on bi-fold panel assembly 140 is positioned inside treatment chamber 12 for exposure to hot air, steam, and/or conditioned and cooled air and removal of wrinkles. Central hinge interlock 270 rotates in a clockwise direction as rear panel 204 pivots from the coplanar orientation relative to front panel 202 to the tensioning configuration shown in FIG. 10 with an included angle between the panels of approximately 60 degrees. As a result, the protrusion of central hinge interlock 270 does not contact the article of clothing installed across central hinges 232, 242 from an outer, clothes mounting surface of front panel 202 to an outer, clothes mounting surface of rear panel 204.

FIGS. 11A, 11B, 11C, and 11D are perspective views and enlarged sectional views showing bi-fold panel assembly 140 on door 20 of the clothes treatment apparatus of FIG. 1, with hangers 220, 222 on panels 202, 204 of bi-fold panel assembly 140 flush with the panels before installation of an article of clothing, and pivoted out from the panels for installation of the article of clothing on the panels. As further shown in FIG. 11A, dimensions of left-half hanger 220 and right-half hanger 222 may be predetermined according to an optimal fixturing position for a shirt of a desired size or shirts of a desired range of sizes. When not in use, each of hangers 220, 222 may sit in a corresponding recess 207 formed in a surface of respective front panel 202 and rear panel 204. As shown in FIGS. 11A-11D, each of hangers 220, 222 can be pivoted out from the respective front panel 202 and rear panel 204 on which it is mounted in order to allow a shirt to be installed on the hangers. The thickness of each hanger and hinge structure may be determined by a desired total thickness of bi-fold panel assembly 140 and strength characteristics associated with supporting a shirt and allowing for tensioning of the shirt while being treated within treatment chamber 12.

Figure 12A:
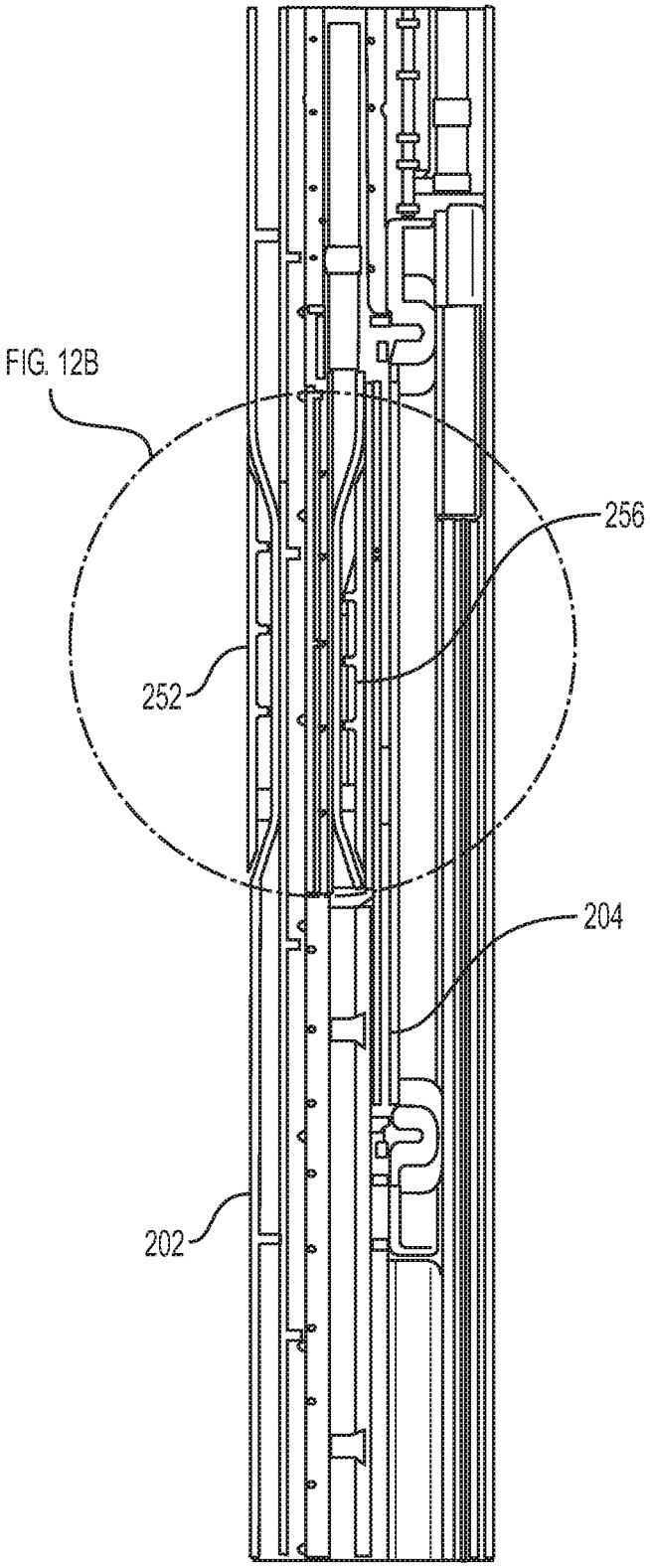
FIGS. 12A and 12B are enlarged sectional views of portions of a bi-fold panel assembly in a closed configuration with clips for clamping on an article of clothing to be tensioned shown flush with outer surfaces of the panels.
Figure 12B:
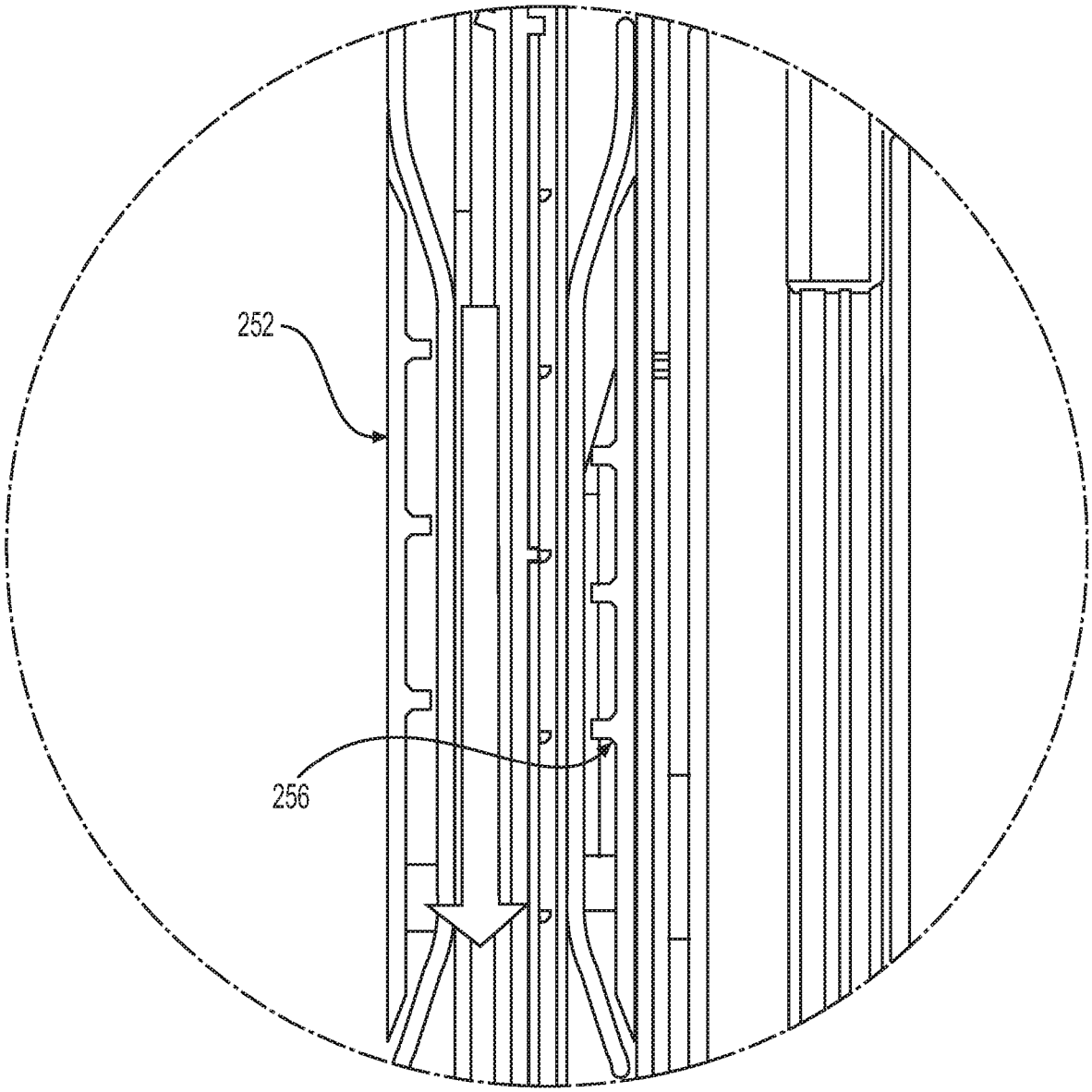
Figure 13A:
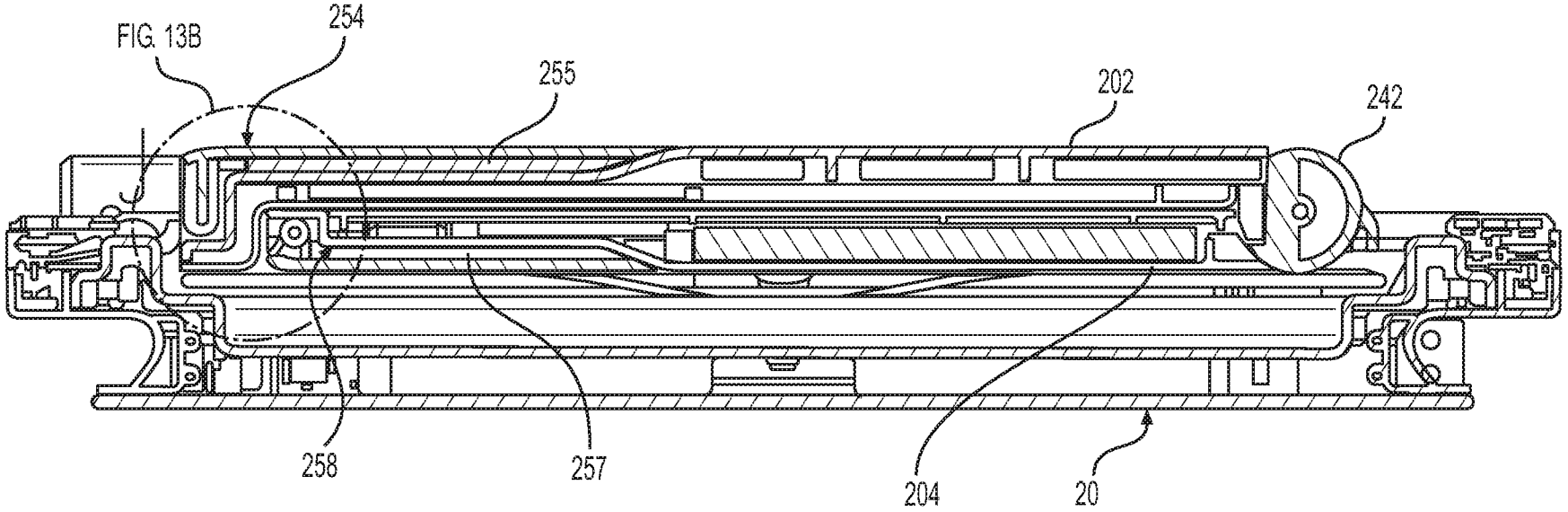
FIGS. 13A and 13B are enlarged sectional views of portions of a bi-fold panel assembly on a door of the clothing apparatus of FIG. 1, showing the biasing feature on some of the clips for clamping on an article of clothing.
Figure 13B:
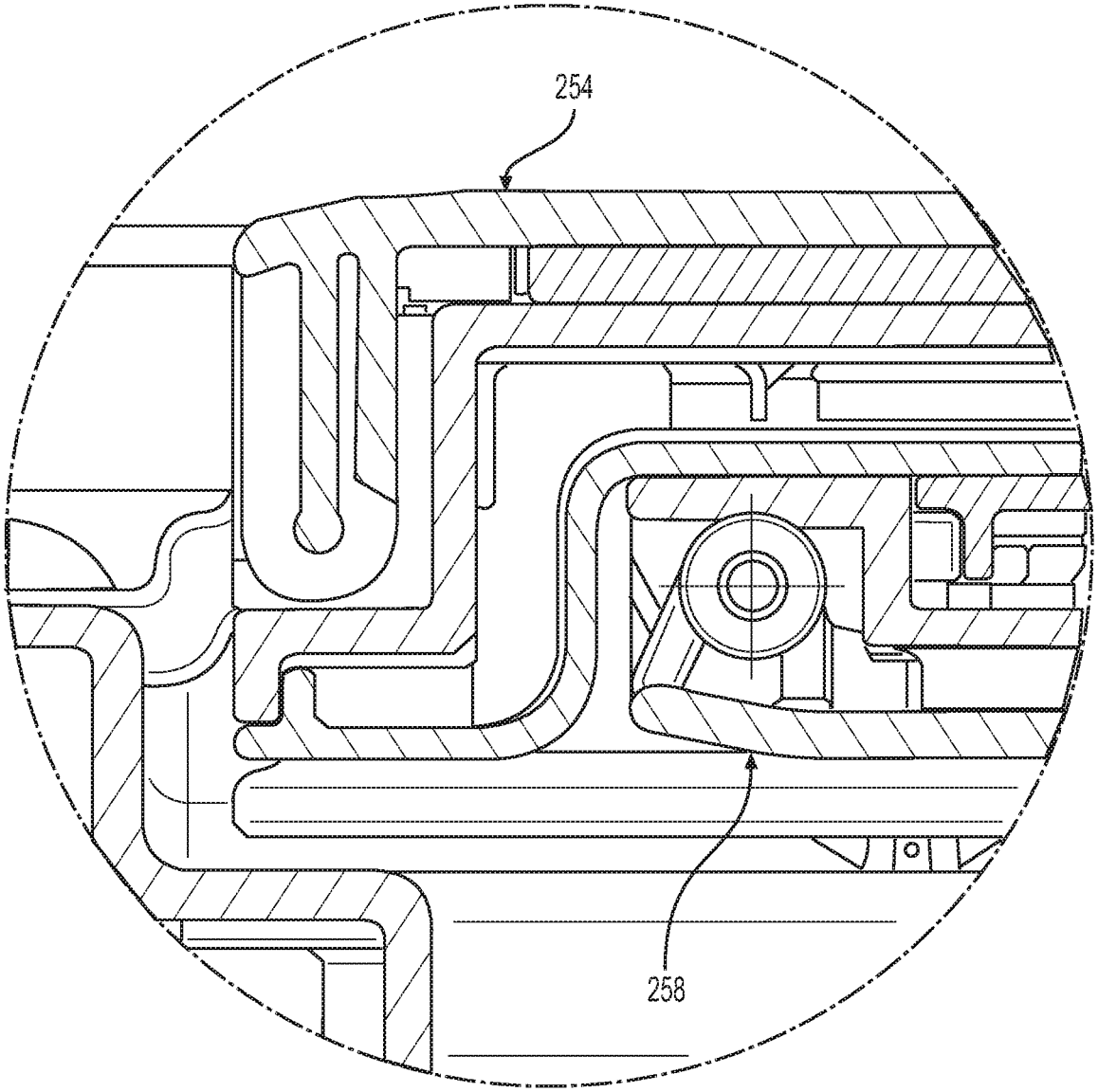

FIGS. 12A and 12B are enlarged sectional views of portions of a bi-fold panel assembly in a closed configuration with front panel 202 folded against and overlapping rear panel 204, and with clips 252, 256 for clamping on an article of clothing to be tensioned shown flush with outer surfaces of front and rear panels 202, 204. FIGS. 13A and 13B are enlarged sectional views of portions of a bi-fold panel assembly positioned against door 20 of the clothing apparatus of FIG. 1, with rear panel 204 folded against and overlapping front panel 202. FIG. 13A shows clips 257, 258 biased into a closed position flush with compression surfaces of rear panel 204 for applying pressure to an article of clothing mounted to a base plate on door 20 or when the bi-fold panel assembly is not in use, and clips 254, 255 biased into a closed position flush with a mounting surface of front panel 202. FIG. 13B shows an enlarged view of an exemplary biasing feature on clips 254, 258.

The width of bi-fold panel assembly 140 and base plate 110 may be a function of the width of cabinet 10 and treatment chamber 12. The bi-fold arrangement allows for articles of clothing that are wider than the width of treatment chamber 12 to be placed on front and rear panels 202, 204 of bi-fold panel assembly 140 when the panels are pivoted around hinges 272, 232, 242 and extended from door 20 to a substantially coplanar configuration while door 20 is opened from cabinet 10. After an article of clothing is mounted and clamped on front and rear panels 202, 204, the panels may be pivoted relative to each other to form a substantially equilaterally triangular tensioning configuration with door 20 and base plate 110, such as shown in FIGS. 2B, 5B, 8C, 8D, and 10. Each side of the triangular configuration of bi-fold panel assembly 140 in a tensioning configuration may have a width dimension that is smaller than the front opening into cabinet 10 by an amount that allows clearance between bi-fold panel assembly 140 and cabinet 10 as door 20 is closed with an article of clothing installed on bi-fold panel assembly 140 and in a tensioning configuration. In this folded, tensioning configuration, as shown in FIG. 8D, door 20 with bi-fold panel assembly 140 may be closed in order to position bi-fold panel assembly 140 with an article of clothing installed in a tensioning configuration inside treatment chamber 12 for exposure to hot air, steam, and/or conditioned and cooled air. An included angle between front panel 202 and rear panel 204 may be approximately 60 degrees, as shown in FIG. 10, with front panel 202, rear panel 204, and base plate 110 essentially forming an equilateral triangle. This position of front and rear panels 202, 204 may be maintained by rear panel secondary interlock 246 located along a distal side edge of rear panel 204 engaging with door catch assembly 248.

In an alternative functional implementation of wrinkle removal module 100 and bi-fold panel assembly 140, bi-fold panel assembly 140 may be maintained in its folded and locked configuration, as shown in FIGS. 3A, 3B, and 9, and pivoted against an article of clothing such as trousers 105 positioned between base plate 110 and rear panel 204 of bi-fold panel assembly 140. This functional implementation of wrinkle removal module 100 enables compression of an article of clothing or other fabric item between bi-fold panel assembly 140 and base plate 110. Each of front panel 202 and rear panel 204 of bi-fold panel assembly 140 may include substantially parallel compression side plates 144 and substantially parallel top and bottom interconnecting plates 142 that join the substantially parallel compression side plates and define the central opening 145 therebetween. As described above, in some embodiments the overall lengths and widths of the compression side plates and top and bottom interconnecting plates may be adjustable to accommodate clothing articles of different sizes.

Figure 8A:
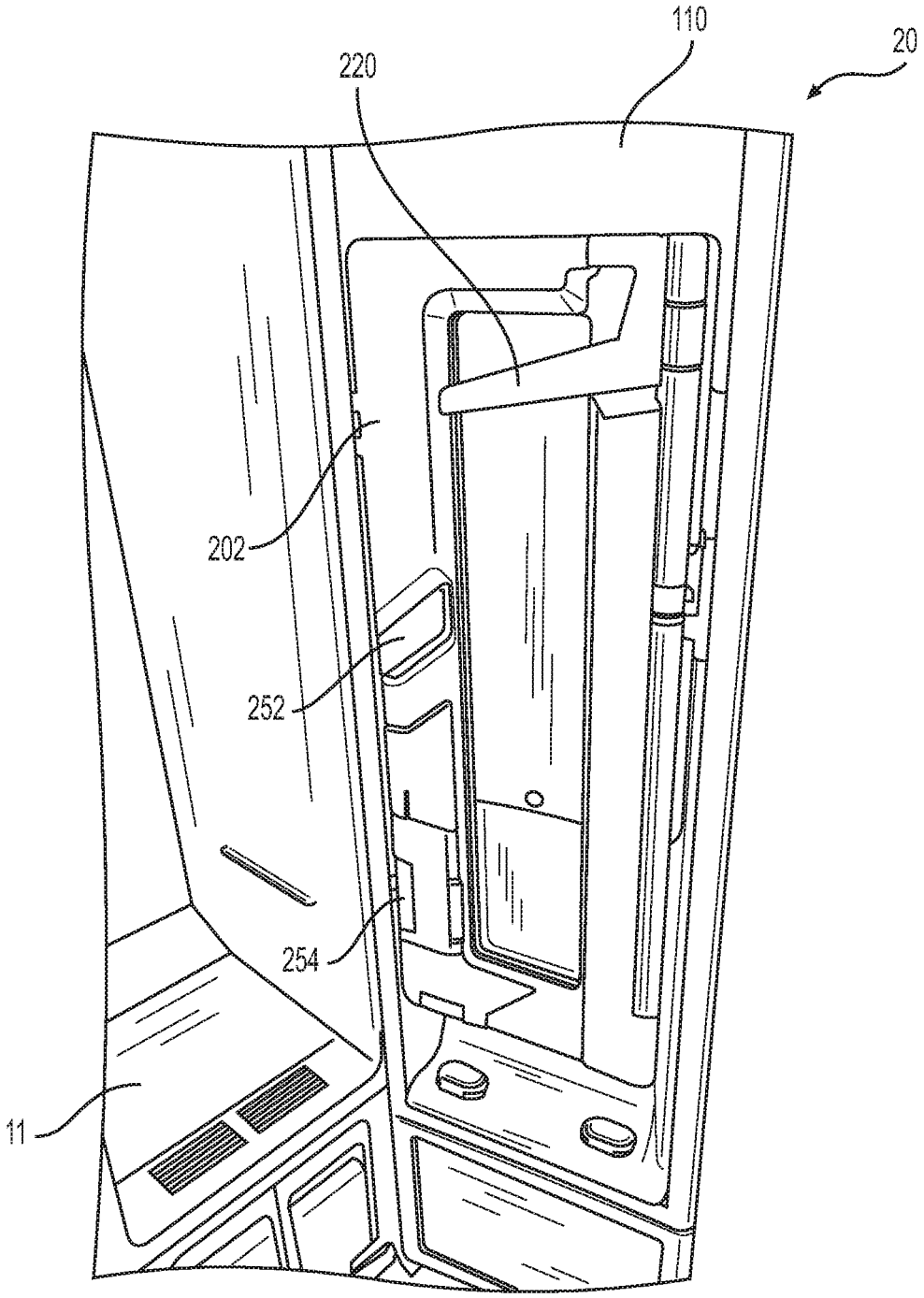
FIGS. 8A, 8B, 8C, and 8D are perspective views of the door and bi-fold panel assembly of an exemplary clothes treatment apparatus at each stage of an installation and tensioning sequence for an article of clothing.
Figure 8B:
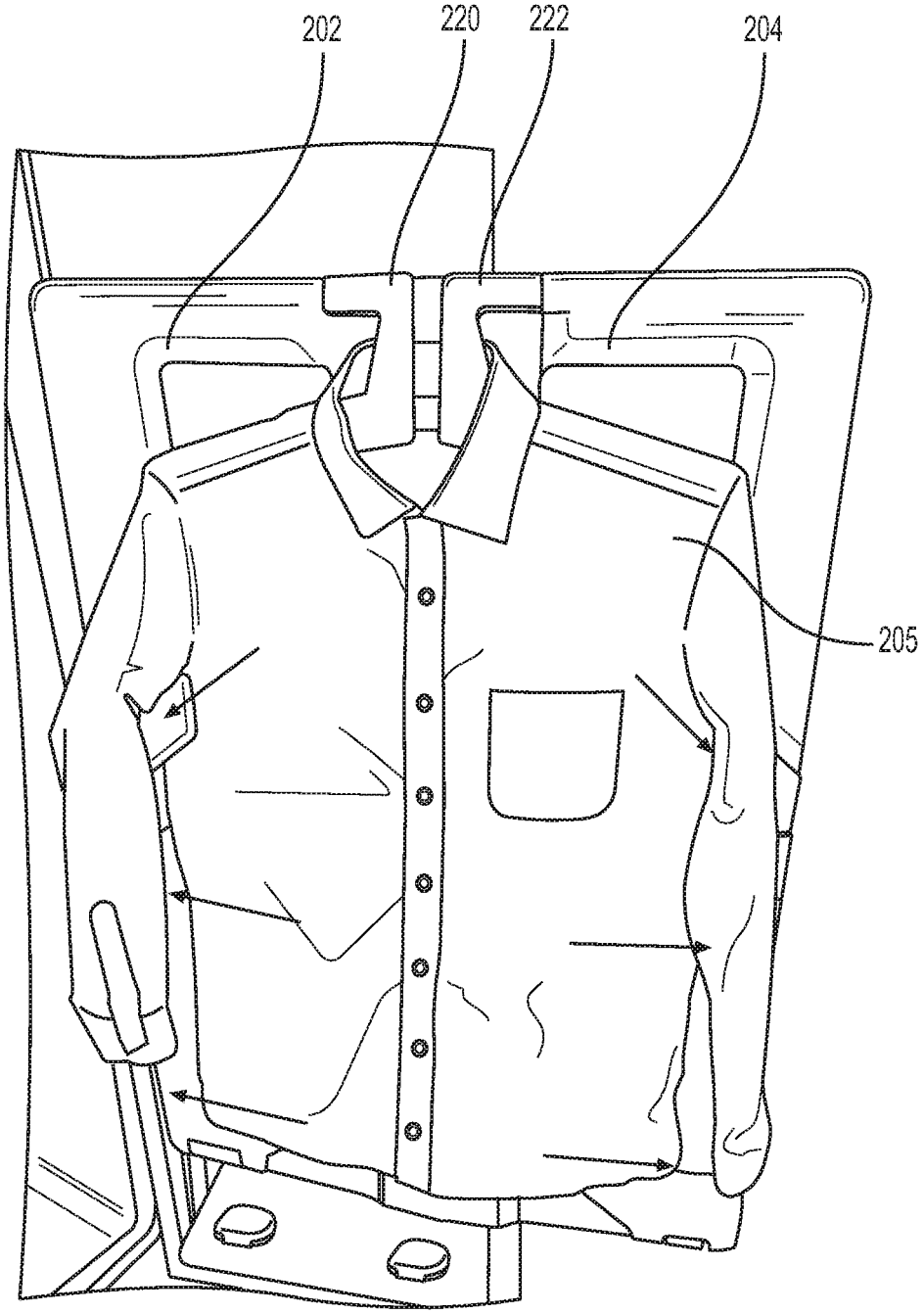
Figure 8C:
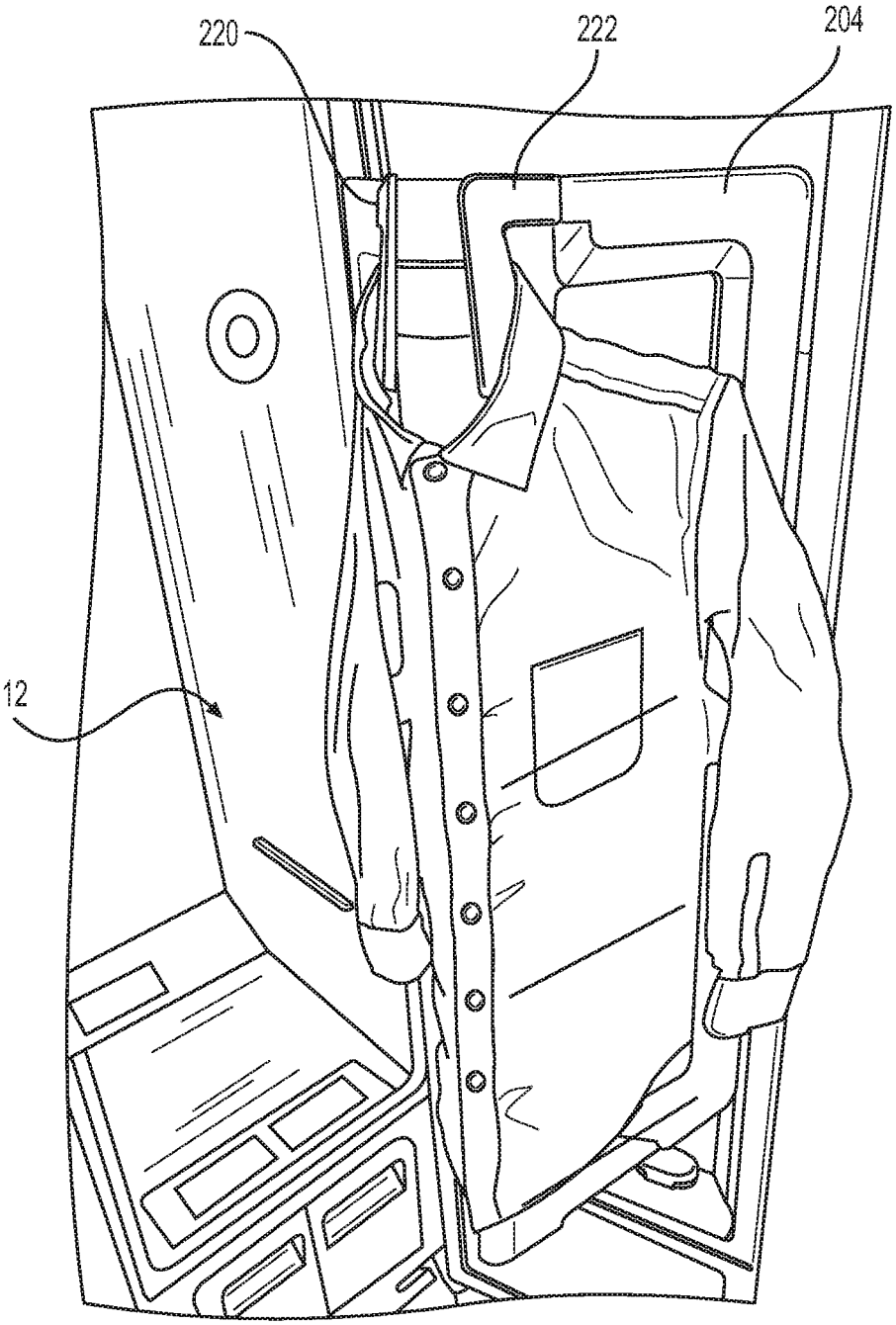
Figure 8D:
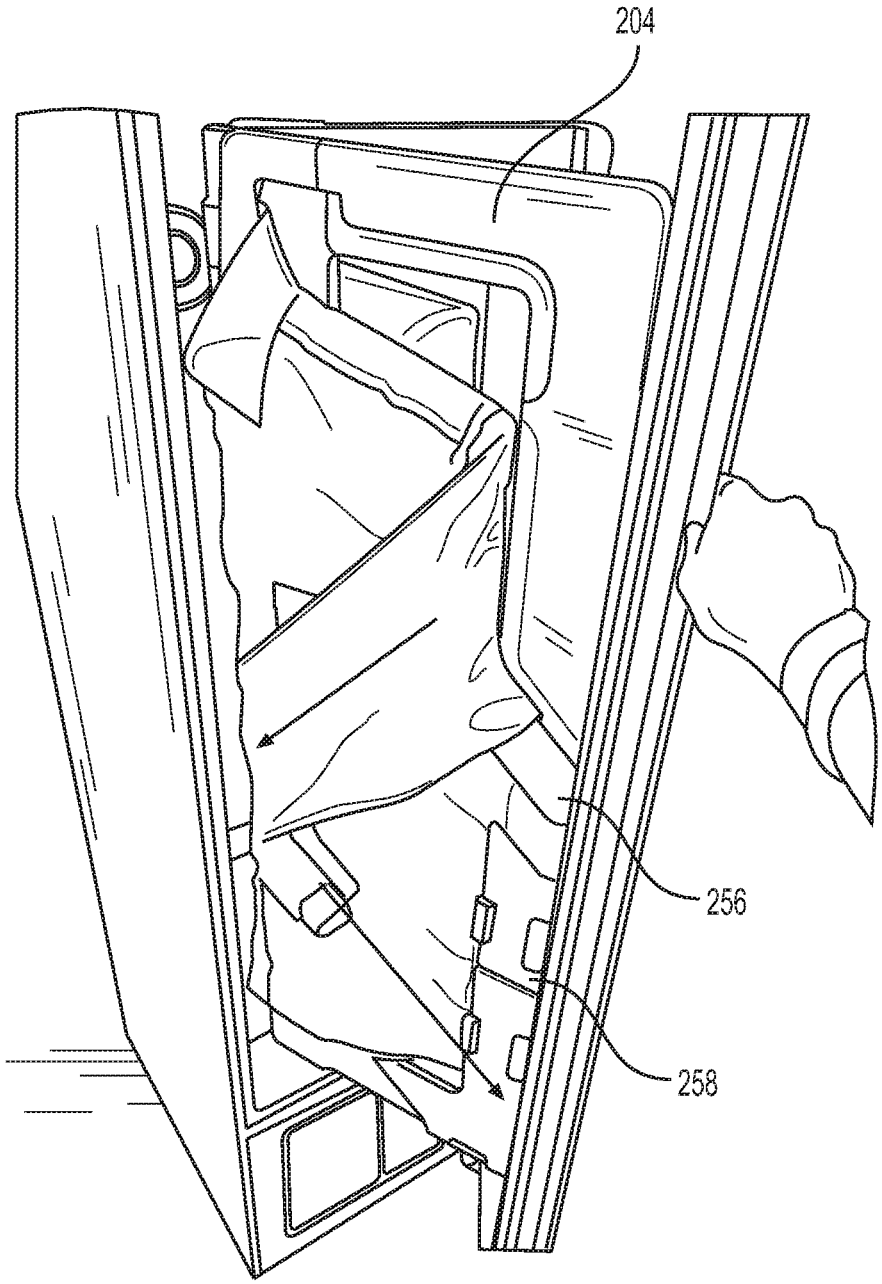
Figure 11A:
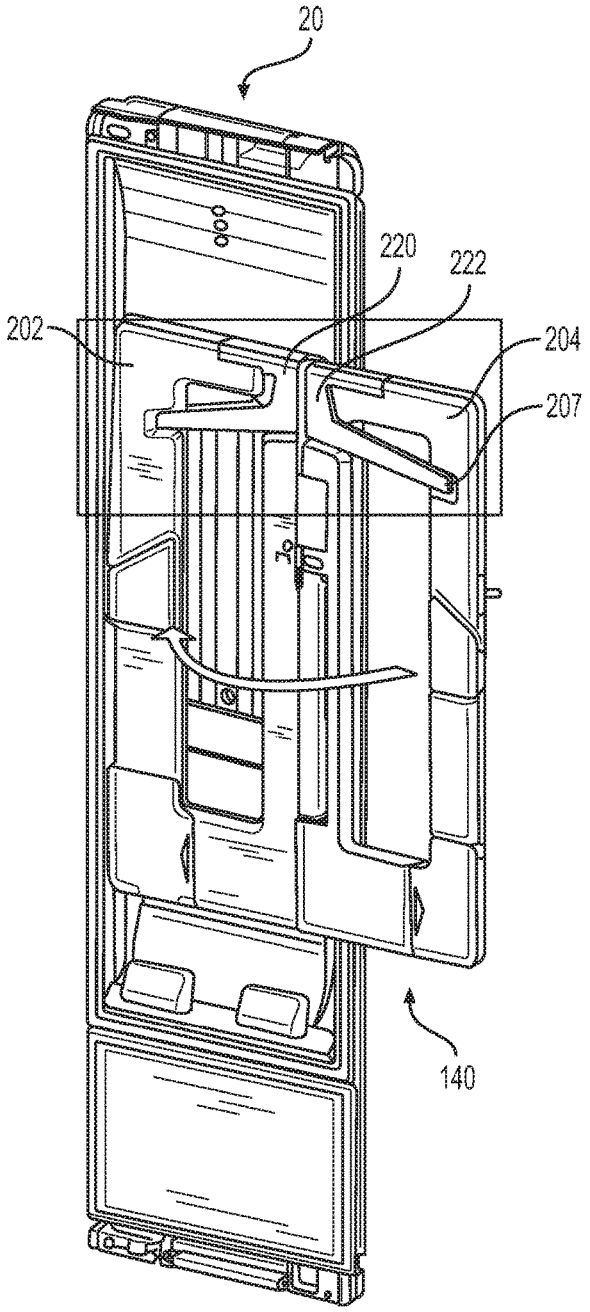
FIGS. 11A, 11B, 11C, and 11D are perspective views and enlarged sectional views showing a bi-fold panel assembly on a door of the clothes treatment apparatus of FIG. 1, with hangers on the panels of the bi-fold panel assembly flush with the panels before installation of an article of clothing and pivoted out from the panels for installation of the article of clothing on the panels.
Figure 11B:
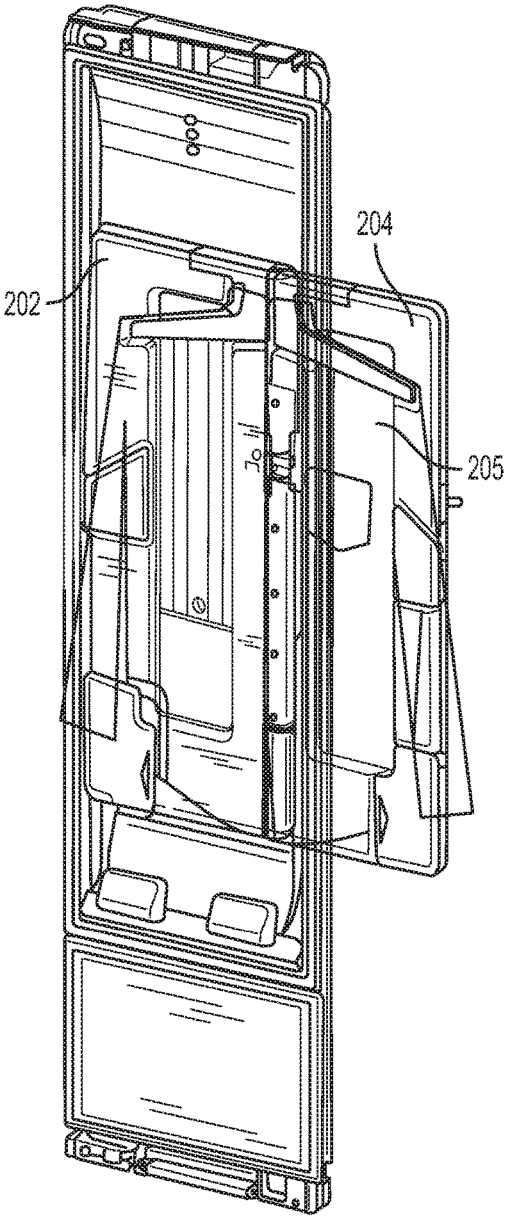
Figure 11C:
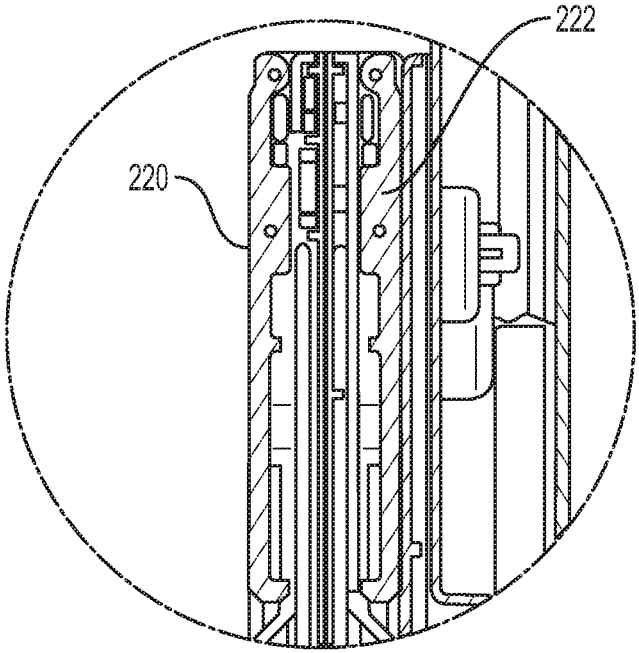
Figure 11D:
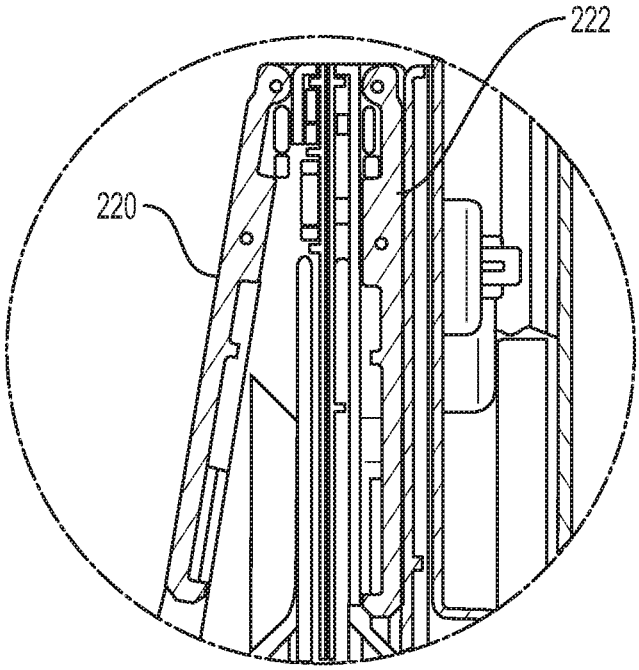

FIGS. 2A, 4A, and 8A illustrate bi-fold panel assembly 140 on door 20 in a folded configuration with rear panel 204 overlapping and positioned behind front panel 202 before application of a shirt 205. FIGS. 4B, 11A, and 11B illustrate bi-fold panel assembly 140 in an unfolded configuration with front panel 202 and rear panel 204 oriented substantially coplanar and contiguous with each other and ready for application of shirt 205. FIGS. 5A, 8B, and 11B illustrate shirt 205 mounted and at least partially clamped on mounting surfaces of front panel 202 and rear panel 204 of bi-fold panel assembly 140 before reconfiguring bi-fold panel assembly 140 into a tensioning configuration. FIGS. 5B, 8C, and 8D illustrate shirt 205 in a tensioning configuration after pivoting front panel 202 and rear panel 204 relative to each other and in a direction away from the mounting surfaces of front panel 202 and rear panel 204 such that the two panels are oriented with approximately a 60 degree included angle therebetween.

As shown in FIGS. 2B, 5A, 5B, FIGS. 8B-8D, and 11B, shirt 205 may be mounted on bi-fold panel assembly 140 by hanging shirt 205 on left-half hanger 220 of front panel 202 and right-half hanger 222 of rear panel 204 when front panel 202 and rear panel 204 are in the unfolded, substantially coplanar and contiguous configuration. The term "substantially coplanar and contiguous" as used herein refers to the two panels of bi-fold panel assembly 140 being oriented in approximately the same plane and forming an interconnected mounting surface that extends from a mounting surface on one side of one panel, along the outer peripheral surfaces of central hinges 232, 242 that pivotally connect the panels, to a mounting surface on the same side of the other panel, within normal manufacturing and assembly tolerances. A certain amount of movement of front panel 202 and rear panel 204 and deviation of the panels from a coplanar and contiguous configuration as the panels pivot about central hinges 232, 242 is expected and can be tolerated while installing shirt 205 or other article of clothing on hangers 220, 222. In addition the buttons of shirt 205 may be buttoned to keep the shirt from slipping off of the hangers.

A person skilled in the art will appreciate that multiple options and modifications to the disclosed bi-fold panel assembly and associated base plate of the disclosed wrinkle removal module with one or more clothes treatment functions may exist. It will be appreciated that the disclosed methods and apparatus are not limited to the specific configurations of panels disclosed. Rather, additional panels other than the disclosed front and rear panels of bi-fold panel assembly 140 may be included when appropriate for pressing or tensioning additional or alternative articles of clothing or fabric items. Additionally, central hinge interlock 270, rear panel secondary interlock 246, and door catch assembly 248 may be configured differently than the exemplary embodiment shown in FIGS. 9 and 10 as long as the interlock and catch assemblies allow the panels 202, 204 of bi-fold panel assembly 140 to be locked in the various positions described above during a clothing article tensioning function and during a clothing article compression function.

A clothes treatment apparatus is provided that is capable of removing wrinkles from one or more articles of clothing, either simultaneously or at separate times in separate configurations.

A clothes treatment apparatus, as embodied and broadly described herein, may include a cabinet that defines a treatment chamber, and steam producing equipment contained within the cabinet that releases steam into the treatment chamber.

The clothes treatment apparatus may include a door that opens and closes the treatment chamber, and a wrinkle removal module located on a backside of the door. The wrinkle removal module may apply a tension force to a first article of clothing in a first configuration of the wrinkle removal module and a compression force to a second article of clothing in a second configuration of the wrinkle removal module. The wrinkle removal module is also capable of applying a tension force to a first article of clothing simultaneously with applying a compression force to a second article of clothing while exposing both of the articles of clothing to hot air and/or steam in a treatment chamber of a cabinet.

The wrinkle removal module of the clothes treatment apparatus may include a plurality of panels, in which a first one of the panels is pivotally supported on the door, and a second one of the panels is pivotally supported on the first one of the panels. In one exemplary implementation, the wrinkle removal module may include a bi-fold panel assembly with a first panel pivotally supported along a proximal edge to a door of the clothes treatment apparatus, and a second panel pivotally supported along a distal edge of the first panel.

The first panel of the bi-fold panel assembly may be a front panel positioned farther away from a base plate mounted in a fixed position on the door of the cabinet, and the second panel of the bi-fold panel assembly may be a rear panel positioned between the front panel and the base plate when the first and second panels are pivoted to a folded, overlapping configuration.

In some implementations, the first and second panels may be adjustable in size as a result of interengaged and interlocked telescoping members or extensions slidably mounted to substantially parallel compression plates of the panels. The telescoping members or slidable extensions may allow for adjustments to an overall length and width of the bi-fold panel assembly to accommodate clothing articles of different sizes.

A first article of clothing may be supported along one side or mounting surface of each of the first and second panels. Each of the panels may include one or more clips configured for clamping on a portion of the first article of clothing to apply a tension force to the first article of clothing when the first and second panels are pivoted relative to each other in a direction away from the one side along which the first article of clothing is mounted.

One or more of the clips may include a front portion that is pivotally connected to and spring loaded toward a rear portion. The one or more clips may include a bump-out locking feature that enables the front portion to remain in an open position during mounting of an article of clothing to the panels. The front portion of a clip with the bump-out locking feature may be released so that it closes against the rear portion to clamp on a portion of the article of clothing when a user applies a small amount of force to over-ride the bump-out locking feature. Special anti-slip pads made from a material such as rubber for gripping on the material of the article of clothing may also be mounted on the inner surfaces of one or both of the front portion and rear portion of the clips.

The clothes treatment apparatus may include a base plate supported in a stationary position on an inner surface of the door that faces the treatment chamber of the clothes treatment apparatus when the door is in a closed position. A bi-fold panel assembly may be pivotally supported on the inner surface of the door, or in some implementations, directly to an edge portion of the base plate. The bi-fold panel assembly may be pivoted into contact with the base plate to apply a compression force to a second article of clothing positioned in between the bi-fold panel assembly and the base plate.

The base plate may be supported in a fixed position on the door, and the bi-fold panel assembly may include the first, front panel pivotally supported on the door, and the second, rear panel pivotally supported on the first, front panel. The first, front panel may be supported on the door along a proximal edge of the first, front panel by one or more hinges, and the second, rear panel may be supported on the first, front panel by one or more central hinges along a distal edge of the first, front panel.

In some implementations, the bi-fold panel assembly may be detachable from the door of the cabinet such that the entire bi-fold panel assembly may be hung on a support rod inside the treatment chamber of the cabinet. In other implementations, only the rear panel may be detachable from the front panel.

A first article of clothing may be supported on hangers along one side, or mounting surface of the first, front panel and the second, rear panel. Each of the first and second panels may include at least one clip that clamps on a portion of the first article of clothing such that a tension force can be applied to the first article of clothing when the first and second panels are pivoted relative to each other in a direction away from the one side.

The first article of clothing may be wider than a width of the cabinet such that the first article of clothing would not fit into the treatment chamber of the clothing apparatus if the first article of clothing were maintained in a flat arrangement. For example, the cabinet of the clothes treatment apparatus may be wide enough to accommodate a pair of trousers, but not wide enough to accommodate a shirt in a buttoned and flat arrangement as it would normally be hung on a hanger.

The first article of clothing may be mounted along the one side or mounting surface of the first and second panels with the door of the cabinet in an open position and the first and second panels positioned in an approximately coplanar first configuration. The first panel may include a left-hand side of an adjustable hanger that is pivotally supported on the first panel, and the second panel may include a right-hand side of an adjustable hanger that is pivotally supported on the second panel. A first article of clothing, such as a shirt, may be mounted on the left-hand side hanger and right-hand side hanger along the one side or mounting surface of the first and second panels. In the case of a shirt, buttons along a central axis of symmetry of the shirt may be buttoned up to maintain the shirt in a centralized position on the left-hand side hanger and right-hand side hanger of the first and second panels, respectively.

Clips along the proximal edge of the first, front panel may be clamped on side portions of the shirt, with one clip clamped in a position at the intersection of the left sleeve of the shirt and the left-hand side of the shirt, and additional side clips clamped along the left-hand side of the shirt from below the left sleeve to the bottom of the shirt. Similarly, clips along the distal edge of the second, rear panel may be clamped on opposite side portions of the shirt, with one clip clamped in a position at the intersection of the right sleeve of the shirt and the right-hand side of the shirt, and additional side clips clamped along the right-hand side of the shirt from below the right sleeve to the bottom of the shirt.

Once the shirt is completely supported on the one side or mounting surface of the first and second panels by the left-hand side and right-hand side of an adjustable hanger, and clamped in position by the clips along both sides of the shirt, the first and second panels may be pivoted relative to each other about the one or more central hinges in a direction away from the one side or mounting surface to a second, tensioning configuration with an acute included angle defined between the first and second panels. Once the first and second panels of the bi-fold panel assembly have been pivoted to the second, tensioning configuration with an acute included angle defined between the panels, the first article of clothing mounted along the one side or mounting surface of the first and second panels will fit into the treatment chamber when the door is closed.

The process of pivoting the first and second panels of the bi-fold panel assembly after mounting and clamping of a shirt on the panels results in a tension being applied to the shirt as the distance from the proximal edge of the first panel to the distal edge of the second panel increases during the pivoting movement as a function of the radius of the central hinges joining the first and second panels. The tension force exerted on the shirt may be in a substantially horizontal direction extending between opposite side seams of the shirt.

The first panel of the bi-fold panel assembly may be pivotally supported on the door along the proximal edge of the first panel by one or more hinges, and the first and second panels may be pivotally connected to each other by one or more central hinges along a distal side edge of the first panel and a proximal side edge of the second panel. The second, rear panel may include a panel interlock feature on a distal side edge of the second panel opposite from the one or more central hinges. The panel interlock feature may include a protrusion that engages with a catch assembly of the door to retain the first and second panels in the second, tensioning configuration with an acute included angle defined between the panels.

An intermediate portion of the one or more central hinges may include a central hinge interlock feature that engages with the catch assembly of the door to retain the bi-fold panel assembly in contact with the base plate when not in use or while applying a compression force to a second article of clothing positioned in between the bi-fold panel assembly and the base plate.

The clips on the first and second panels may include one or more spring-loaded clips biased from an open position to a closed position for clamping on a portion of the first article of clothing. When the clips are in a closed position the clips may be flush with or below the mounting surface along the one side of the first and second panels. This ensures that the clips do not interfere with the smooth, compression surfaces of the rear panel of the bi-fold panel assembly when the bi-fold panel assembly is pivoted into contact with the base plate for compression of an article of clothing mounted on the base plate. The clips may include a fixed, upper clip with an upper edge that is diagonal to horizontal. The fixed, upper clip may engage with and clamp on a portion of a shirt at an intersection of a sleeve portion of the shirt and a body portion of the shirt. The one or more spring-loaded clips may clamp on a side edge of the body portion of the shirt below the sleeve portion of the shirt.

A method of removing wrinkles from articles of clothing may use a clothes styling apparatus incorporating various aspects of this disclosure, where the clothes styling apparatus includes a cabinet that defines a treatment chamber, steam producing equipment contained within the cabinet and configured to release steam into the treatment chamber, a door that opens and closes the treatment chamber, a base plate supported in a stationary position on a backside of the door, and a wrinkle removal module pivotally mounted on the backside of the door. The method of removing wrinkles may include applying a tension force to a first article of clothing in a first configuration of the wrinkle removal module, and applying a compression force to a second article of clothing in a second configuration of the wrinkle removal module.

The wrinkle removal module may include a bi-fold panel assembly that includes a first panel pivotally supported on the door, and a second panel pivotally supported on the first panel. Each of the first and second panels may include at least one clip for clamping on respective portions of the first article of clothing. The method of removing wrinkles may include supporting the first article of clothing along one side of the first and second panels. The first article of clothing may be supported along the one side of the first and second panels in a vertical direction by hanging the first article of clothing on adjustable hangers that engage with inside shoulder portions of the article of clothing. The first article of clothing may also be supported in a horizontal direction by clamping on a first side of the first article of clothing with a first clip on a proximal side edge of the first panel and on a second, opposite side of the first article of clothing with a second clip on a distal side edge of the second panel.

After mounting and clamping the first article of clothing along the one side of the first and second panels, a tension force in a substantially horizontal direction may be applied to the first article of clothing by pivoting the first and second panels relative to each other in a direction away from the one side. When the first article of clothing is a shirt with shirt sleeves, the sleeves of the shirt may also be subjected to tension forces by crossing the left sleeve of the shirt over to the right side of the shirt and crossing the right sleeve of the shirt over to the left side of the shirt, and clamping on the cuff ends of the left and right sleeves with additional clips that apply a tension force to each sleeve in a direction of the axis of each sleeve. The clips that apply a tension force to each sleeve as the first and second panels are pivoted relative to each other may be cable rewound tensioner clips with internal coiled springs contained in a base portion attached through cable extensions to the clips such that a tension force applied by the clips to portions of an article of clothing may be redirected by anchoring the base portion at different locations on a door of the clothes treatment apparatus, on the bi-fold panel assembly, or at other locations within the cabinet of the clothes treatment apparatus.

When a width of the first article of clothing is wider than a width of the cabinet of the clothes treatment apparatus, the method of removing wrinkles from the first article of clothing may include opening the door of the cabinet, and unfolding the first and second panels by pivoting the second panel relative to the first panel until the first and second panels are substantially coplanar. After arranging the first and second panels in the coplanar configuration, the first article of clothing may be supported on hangers along one side of the first and second panels with the door in an open position. The use of two, pivotally connected panels enables the mounting of an article of clothing with twice the width of a single panel. After supporting the first article of clothing on the hangers, and buttoning up any buttons along the central axis of symmetry of the first article of clothing, the clips along opposite side portions of the first article of clothing may be clamped on the opposite sides of the first article of clothing.

With the first article of clothing mounted and clamped on the bi-fold panel assembly, the first and second panels may be pivoted relative to each other in a direction away from the one side to the first configuration of the wrinkle removal module with an acute included angle between the first and second panels such that the first article of clothing mounted along the one side of the first and second panels will fit into the treatment chamber when the door is closed.

In one exemplary method of removing wrinkles simultaneously from two articles of clothing, a first article of clothing may be mounted and clamped on the panels of the bi-fold panel assembly, the bi-fold panel assembly may be pivoted until the front and rear panels are substantially parallel and overlapping each other, thus subjecting the first article of clothing to tension forces, and the bi-fold panel assembly may be pivoted relative to the door to bring the rear panel into contact with the base plate with at least a portion of a second article of clothing compressed in between the rear panel and the base plate. Alternatively, the front and rear panels may be pivoted to the parallel, overlapping configuration without any article of clothing mounted on the bi-fold panel assembly. A central hinge interlock feature of the bi-fold panel assembly may be engaged with a catch assembly on the door to maintain the bi-fold panel assembly against the base plate with the second article of clothing compressed in between the rear panel and the base plate. The bi-fold panel assembly in a folded configuration and applying tension forces to a first article of clothing may also apply compression forces to a second article of clothing positioned in between the rear panel of the bi-fold panel assembly and the base plate on the door. The door may then be closed such that the first and second articles of clothing are contained within the treatment chamber where they can be subjected to hot air and/or steam to assist with the removal of wrinkles.

The elements in the claims are to be interpreted broadly based on the language employed in the claims and not limited to examples described in the present specification or during the prosecution of the application, which examples are to be construed as non-exclusive. It is intended, therefore, that the specification and examples be considered as exemplary only, with a true scope and spirit being indicated by the following claims and their full scope of equivalents.

What is claimed is:

1. A clothes treatment apparatus comprising:

a cabinet that defines a treatment chamber;

steam producing equipment contained within the cabinet and configured to release steam into the treatment chamber;

a door connected by one or more hinges to the cabinet and configured to open and close the treatment chamber;

a base plate supported in a fixed position on a backside of the door; and a wrinkle removal module pivotally connected to the backside of the door and being configured to apply a tension force to a first article of clothing in a first configuration of the wrinkle removal module and apply a compression force to a second article of clothing in a second configuration of the wrinkle removal module, wherein the wrinkle removal module includes a bi-fold panel assembly pivotally connected to the backside of the door or the base plate, wherein the bi-fold panel assembly includes:

a first panel pivotally connected to the backside of the door or the base plate; and a second panel pivotally connected on the first panel, wherein one side of the first panel is pivotally connected to the backside of the door or the base plate and the second panel is rotatably coupled to an other side of the first panel, and wherein the bi-fold panel assembly modifies a configuration of the first panel and the second panel through rotation of the first panel and the second panel.

2. The clothes treatment apparatus of claim 1, wherein the bi-fold panel assembly is pivotally connected to the backside of the door and is configured to be pivoted into contact with the base plate to apply the compression force to the second article of clothing positioned in between the bi-fold panel assembly and the base plate.

3. The clothes treatment apparatus of claim 2, wherein the wrinkle removal module comprises:

one or more hangers configured for supporting the first article of clothing along one side of the first and second panels, and wherein each of the first and second panels including at least one clip mounted along an outer side edge of the respective panel for holding a portion of the first article of clothing to apply the tension force to the first article of clothing when the first and second panels are pivoted relative to each other in a direction away from the one side.

4. The clothes treatment apparatus of claim 3, wherein the width of the cabinet is less than an overall width of the first article of clothing when the first article of clothing is supported on the one or more hangers in a flat configuration, an overall width along the one side of the first and second panels with the door in an open position and the first and second panels positioned in an approximately coplanar first configuration being wide enough for mounting the first article of clothing along the one side in the flat configuration, and the first and second panels being pivoted relative to each other in a direction away from the one side to a second configuration with an acute included angle between the first and second panels such that the first article of clothing mounted along the one side of the first and second panels will fit into the treatment chamber when the door is closed.

5. The clothes treatment apparatus of claim 4, wherein the first panel is pivotally supported on the backside of the door by one or more hinges, the first and second panels being pivotally connected to each other by a central hinge, and the second panel comprising a panel interlock feature on a distal side edge of the second panel opposite from the central hinge, the panel interlock feature being configured to engage with a catch assembly of the door to retain the first and second panels in the second configuration.

6. The clothes treatment apparatus of claim 5 wherein a portion of the central hinge is configured to include a central hinge interlock, the central hinge interlock being configured to engage with the catch assembly of the door to retain the bi-fold panel assembly in contact with the base plate when not in use or while applying the compression force to the second article of clothing positioned in between the bi-fold panel assembly and the base plate.

7. The clothes treatment apparatus of claim 6, wherein the central hinge interlock includes a hinge protrusion configured to be inserted into the catch assembly for engaging the central hinge interlock with the catch assembly and configured to be rotated together with the second panel and in an opposite direction than the second panel.

8. The clothes treatment apparatus of claim 3, wherein the clips mounted along outer side edges of the first and second panels include one or more spring-loaded clips biased from an open position for clamping on a portion of the first article of clothing to a closed position when not in use in which the clips are flush with or below an outer surface along the one side of the first and second panels.

9. The clothes treatment apparatus of claim 8, wherein the clips include a fixed, upper clip with an upper edge diagonal to horizontal, the fixed, upper clip being configured to engage with a portion of a shirt at an intersection of a sleeve portion of the shirt and a body portion of the shirt, and the one or more spring-loaded clips being configured to clamp on a side edge of the body portion of the shirt below the sleeve portion of the shirt.

10. The clothes treatment apparatus of claim 2, further comprising one or more tensioner clips anchored to one or more of the cabinet, the door, or the wrinkle removal module, and configured to apply a tension force to the first article of clothing in the first configuration of the wrinkle removal module.

11. The clothes treatment apparatus of claim 2, wherein each of the panels including at least one clip mounted on the respective panel and configured for holding a portion of the first article of clothing, the clip configured to apply the tension force to the first article of clothing when the first and second panels are pivoted relative to each other in a direction away from a side of the first and second panels configured for mounting the first article of clothing.

12. The clothes treatment apparatus of claim 1, wherein, in the first configuration, the first panel and the second panel are arranged to form an acute angle toward the door between the first panel and the second panel.

13. The clothes treatment apparatus of claim 12, wherein, in the second configuration, the first panel and the second panel are folded and overlapped through rotation with respect to each other.

14. The clothes treatment apparatus of claim 12, wherein the wrinkle removal module is configured to apply a tension force to the first article of clothing in a third configuration of the wrinkle removal module, and wherein the first panel and the second panel rotate with respect to each other and form a coplanar configuration in the third configuration.

* * * * *